US007794909B2

(12) United States Patent
Kaya et al.

(10) Patent No.: US 7,794,909 B2
(45) Date of Patent: Sep. 14, 2010

(54) TONER

(75) Inventors: Takaaki Kaya, Suntou-gun (JP); Shigeto Tamura, Suntou-gun (JP); Ryoichi Fujita, Chofu (JP); Ayako Sekikawa, Susono (JP); Makoto Kambayashi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/498,048

(22) Filed: Jul. 6, 2009

(65) Prior Publication Data

US 2009/0263738 A1 Oct. 22, 2009

Related U.S. Application Data

(63) Continuation of application No. PCT/JP2009/054418, filed on Mar. 9, 2009.

(30) Foreign Application Priority Data

Mar. 10, 2008 (JP) ..... 2008-059754

(51) Int. Cl.
*G03G 9/08* (2006.01)

(52) U.S. Cl. ..... 430/110.3; 430/108.22; 430/109.4; 430/109.5

(58) Field of Classification Search ..... 430/108.22, 430/109.4, 109.5, 110.2, 110.3
See application file for complete search history.

(56) References Cited

U.S. PATENT DOCUMENTS

| | | | | |
|---|---|---|---|---|
| 5,399,455 | A | 3/1995 | Mikami et al. | |
| 5,620,826 | A | 4/1997 | Tavernier et al. | |
| 7,005,480 | B2 | 2/2006 | Kinsho et al. | |
| 2005/0238984 | A1* | 10/2005 | Kaburagi et al. | 430/109.1 |
| 2007/0015851 | A1 | 1/2007 | Akutagawa et al. | |
| 2007/0015852 | A1 | 1/2007 | Akutagawa et al. | |
| 2008/0171280 | A1 | 7/2008 | Ohmura et al. | |
| 2009/0035685 | A1 | 2/2009 | Tamura et al. | 430/109.4 |
| 2009/0170021 | A1 | 7/2009 | Kaya et al. | 430/109.4 |

FOREIGN PATENT DOCUMENTS

| | | | |
|---|---|---|---|
| JP | 5-297622 | A | 11/1993 |
| JP | 6-337538 | A | 12/1994 |
| JP | 7-199522 | A | 8/1995 |
| JP | 8-015901 | A | 1/1996 |
| JP | 8-248680 | A | 9/1996 |
| JP | 2001-166529 | A | 6/2001 |
| JP | 3455523 | B2 | 10/2003 |
| JP | 2004-226572 | A | 8/2004 |
| JP | 2004-271919 | A | 9/2004 |
| JP | 2005-241937 | A | 9/2005 |
| JP | 2006-206848 | A | 8/2006 |
| JP | 2006-317489 | A | 11/2006 |
| JP | 2008-175951 | A | 7/2008 |
| JP | 2008-191365 | A | 8/2008 |
| WO | 2005/073287 | A1 | 8/2005 |

* cited by examiner

*Primary Examiner*—Hoa V Le
(74) *Attorney, Agent, or Firm*—Fitzpatrick, Cella, Harper & Scinto

(57) ABSTRACT

An object of the present invention is to provide a spherical toner that has a sharp particle size distribution and a small particle diameter. This is a capsule-type toner that exhibits an excellent low-temperature fixability, while at the same time having a high offset resistance and excellent charging properties and having the ability to provide a high-quality image in which the characters, lines, and dots are precisely defined. The object is achieved by a toner comprising a toner particle that comprises at least (a) resin having polyester as the main component, colorant, wax, and (b) urethane resin, wherein the hydroxyl value per specific surface area of the toner particle is fall into the specific range, and wherein a Tg(0.5) and a Tg(4.0)-Tg(0.5) of the toner fall into specific range.

14 Claims, 3 Drawing Sheets

TONER

CROSS-REFERENCE TO RELATED APPLICATION

This application is a continuation of International Application No. PCT/JP2009/054418, filed Mar. 9, 2009.

BACKGROUND OF THE INVENTION

1. Field of the Invention

The present invention relates to a toner for use in recording methods that employ, for example, electrophotography, electrostatic recording, toner jet recording, and so forth. More particularly, the present invention relates to a toner for use in copiers, printers, and facsimile devices that produce a fixed image by forming a toner image on an electrostatic latent image bearing member, subsequently forming a toner image by transfer to a transfer material, and fixing this toner image by the application of heat and pressure.

2. Description of the Related Art

Achieving a lower energy consumption has in recent years been regarded as a major technical issue also for electrophotographic devices, and an example in this regard is obtaining a substantial reduction in the amount of heat used by the fixing apparatus. Accordingly, with respect to the toner, there is increasing need for fixing to be made possible at lower temperatures, that is, there is increasing need for "low-temperature fixability".

Endowing the binder resin with a sharper melting behavior is already known as an effective method for enabling fixing to occur at lower temperatures. Polyester resins exhibit excellent properties in this regard.

Viewed from another perspective, i.e., that of raising the image quality, reducing the toner particle diameter and providing a sharper toner particle size distribution are pursued in order to increase the resolution and definition, while a spherical toner is suitably used for the purpose of improving the transfer efficiency and flowability. Wet methods have entered into use as methods for efficiently producing spherical toner particles that have small particle diameters.

The "solution suspension" method has been introduced as a wet method that can use sharp-melting polyester resin (Patent Reference 1). In this "solution suspension" method, spherical toner particles are produced by dissolving the resin component in a water-immiscible organic solvent and dispersing this solution in an aqueous phase to form oil droplets. This method can conveniently provide a spherical toner that has a small particle diameter and that employs a binder resin of polyester with its excellent low-temperature fixability.

Within the sphere of the aforementioned toner particles produced by the solution suspension method and having polyester as the binder resin, capsule-type toner particles have also been introduced with the goal of an even lower low-temperature fixability.

The following method is provided in Patent Reference 2: polyester resin, an isocyanate group-functional low molecular weight compound, and other components are dissolved and dispersed in ethyl acetate to produce an oil phase and liquid droplets in water are produced. As a result, the interfacial polymerization of the isocyanate group-functional compound at the liquid droplet interface yields a capsule toner particle having polyurethane or polyurea for its outermost shell.

Patent References 3 and 4 each provide a method in which a toner base particle is produced by the solution suspension method in the presence of resin microparticles of at least one selection from vinyl resins, polyurethane resins, epoxy resins, and polyester resins and in which a toner particle is produced in which the surface of the toner base particle is coated by these resin microparticles.

Patent Reference 5 provides a toner particle obtained by a solution suspension method that employs urethane-modified polyester resin microparticles as a dispersant.

Patent Reference 6 provides a core/shell-type toner particle composed of a shell layer (P) of one or more film-like layers comprising polyurethane resin (a) and one core layer (O) comprising a resin (b).

This core/shell-type toner particle has a configuration in which the core portion is caused to have a low viscosity and the deterioration in the resistance to hot storage is compensated by the resistance to hot storage of the shell portion. In this case, a strategy is required in order to provide a shell portion that is somewhat robust to heating, e.g., strong crosslinking or a high molecular weight, which results in a tendency for the low-temperature fixability to be impaired.

When, in particular, a urethane resin is used as the dispersant, the resistance to hot storage declines in accordance with the decline in the softening point of this resin. It therefore becomes necessary to provide a urethane resin that satisfies the desired Tg and that is sharper melting. However, when the desired urethane resin is obtained by carrying out a urethane formation reaction using a plurality of monomer species, for example, monomer with a functional group moiety that provides resistance to solubility in solvent, monomer for adjusting the softening point, and so forth, the difference in reaction rates causes a broadening of the molecular weight, which as a result impairs the ability to achieve a sharp-melt property for the toner. In addition, when these functional groups are decreased, the particle size distribution becomes nonuniform and/or the resin becomes buried in the toner particle and the ability to form a shell layer is impaired.

Moreover, when a shell layer is formed at the toner particle surface using a urethane resin as the dispersant, the functional group characteristics tend to be picked up by the toner's charging behavior. As a result, problems tend to appear with the charging behavior and stability under various environments.

Due to this, the development is required, from the perspective of both toner production and toner properties, of a dispersant that employs an improved urethane resin.

Patent Reference 1: Japanese Patent Application Laid-open No. H08-248680

Patent Reference 2: Japanese Patent Application Laid-open No. H05-297622

Patent Reference 3: Japanese Patent Application Laid-open No. 2004-226572

Patent Reference 4: Japanese Patent Application Laid-open No. 2004-271919

Patent Reference 5: Japanese Patent No. 3,455,523

Patent Reference 6: International Publication WO 2005/073287

SUMMARY OF THE INVENTION

The present invention was pursued in view of the previously described problems and seeks to provide a toner that, while being a capsule-type toner that exhibits an excellent low-temperature fixability, also exhibits a high offset resistance and an excellent charging behavior. In addition, the present invention seeks to obtain a high quality image in which characters, lines, and dots are precisely defined. The present invention also seeks to provide a spherical toner that has a small particle diameter and a sharp particle size distribution.

The toner of the present invention comprises a toner particle that comprises at least (a) resin having polyester as the main component, colorant, wax, and (b) urethane resin, wherein the hydroxyl value per specific surface area of the toner particle is at least 0.5 mg KOH $m^2$ and no more than 10.0 mg KOH/$m^2$, the toner has a Tg(0.5) of at least 40° C. and no more than 60° C. and a Tg(4.0)-Tg(0.5) of at least 2.0° C. and no more than 10.0° C., where Tg(0.5) is the glass transition temperature of the toner measured with a differential scanning calorimeter (DSC) at a rate of temperature rise of 0.5° C./min and Tg(4.0) is the glass transition temperature of the toner measured with the DSC at a rate of temperature rise of 4.0° C./min.

The toner of the present invention comprises a toner particle that comprises (a) resin having polyester as the main component, colorant, wax, and (b) urethane resin. The use of the (a) resin having polyester as the main component makes it possible to obtain a toner particle that has the sharp-melt property exhibited by polyesters. In addition, the use of colorant and wax enables the realization of an oil-less fixing that supports color.

Moreover, by controlling—in accordance with a preferred embodiment of the present invention—the hydroxyl value per specific surface area of the toner particle, the charging behavior of the toner can be controlled and a toner can be provided that can satisfy the properties related to different charging under different environments and different charging post-storage.

Further features of the present invention will become apparent from the following description of exemplary embodiments (with reference to the attached drawings).

Figure 1:
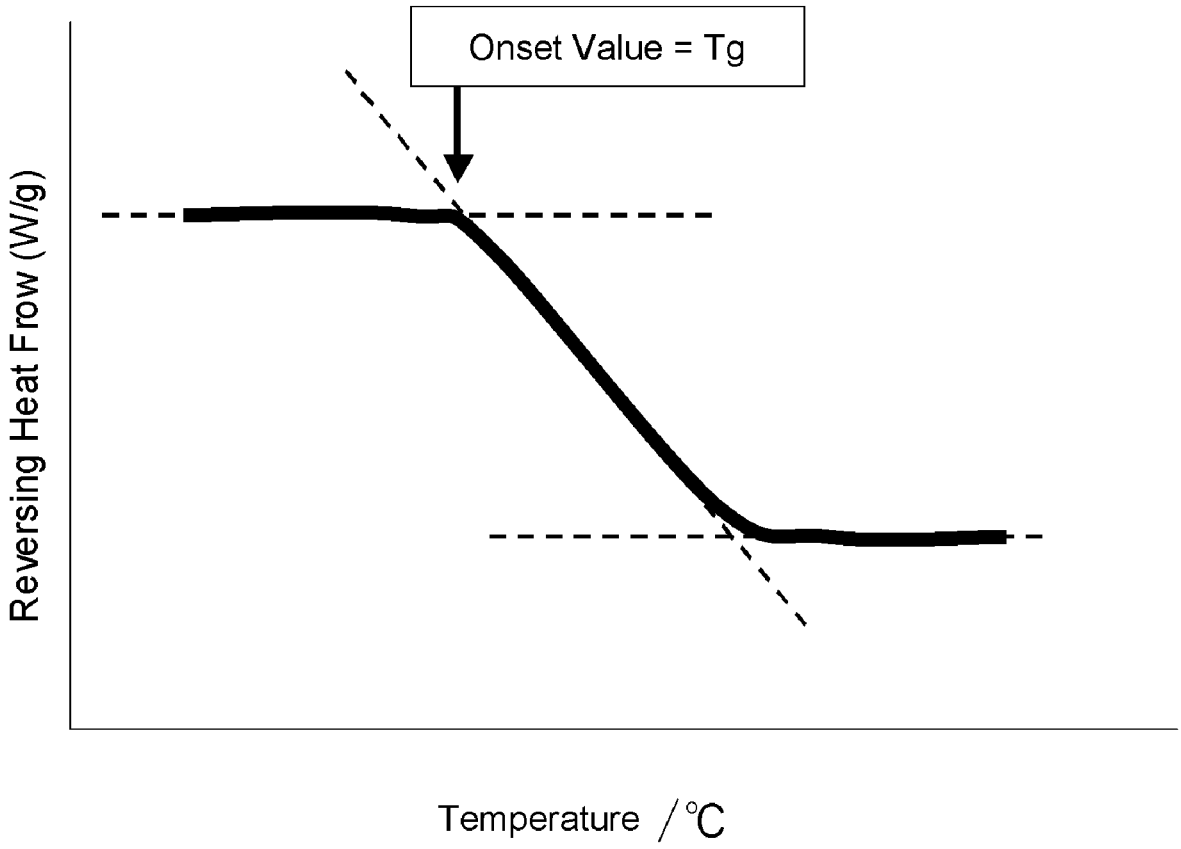
FIG. 1 shows the method of determining Tg using a DSC curve.

1 suction device (at least the portion in contact with the measurement device 2 is an insulator)
2 metal measurement container
3 500-mesh screen
4 metal cap
5 vacuum gauge
6 air stream control valve
7 suction port
8 capacitor
9 potentiometer

DESCRIPTION OF THE EMBODIMENTS

The toner of the present invention comprises a toner particle that comprises at least (a) resin having polyester as the main component, colorant, wax, and (b) urethane resin, wherein the hydroxyl value per specific surface area of the toner particle is at least 0.5 mg KOH/$m^2$ and no more than 10.0 mg KOH/$m^2$, the toner has a Tg(0.5) of at least 40° C. and no more than 60° C. and a Tg(4.0)-Tg(0.5) of at least 2.0° C. and no more than 10.0° C., where Tg(0.5) is the glass transition temperature of the toner measured with a differential scanning calorimeter (DSC) at a rate of temperature rise of 0.5° C./min and Tg(4.0) is the glass transition temperature of the toner measured with the DSC at a rate of temperature rise of 4.0° C./min.

The present invention provides a satisfactory heat resistance and fixing performance using a capsule-type toner. There had been a tendency in the case of capsule-type toners—due to the disposition of a relatively high viscosity shell layer on the toner particle surface—for an impairment of the fixing performance to readily arise, although a satisfactory heat resistance could be obtained. The present invention solves this problem by carrying out production of the capsule-type toner using, as the dispersant during toner production, a resin microparticle containing a specific urethane resin.

Urethane resins generally have a higher viscosity at a lower temperature than polyesters and can incorporate any functional group into the resin. However, an impaired fixing performance had been prone to occur when a urethane resin was present in the surface layer of toner. In addition, it had tended to be difficult to achieve a sharp-melt property with urethane resins due to their nonuniform molecular weight distribution.

The present inventors first started out with an improvement in the sharp-melt property of urethane resins. Decreasing the quantity of urethane bonds in the urethane resin in the required range was first necessary in order to lower the viscosity and preserve the sharp-melt property. However, when the urethane resin was used as the dispersant when toner particles were produced by the solution suspension method, it was quite difficult to produce the particles because the urethane resin dissolved in the solvent used for the resin solution.

The present inventors therefore turned their attention to the terminal groups in the urethane resin. Urethane resins are produced by the reaction of a diisocyanate component and a diol component. Production is carried out in this reaction process by raising the reaction rate by introducing an excess of the diisocyanate component. The isocyanate group remains at the terminals when this is done. A urethane resin can be obtained by terminal modification or crosslinking of these isocyanate groups.

The quantity of the diisocyanate component was first reduced in the present invention with the goal of reducing the quantity of urethane bonds. The quantity of diol component was increased at the same time. As a result, the sought-after viscoelasticity could be obtained and a sharp-melting urethane resin could be obtained.

However, although the targeted resin characteristics were obtained, the heat resistance of the toner particles was unsatisfactory because during toner particle production the resin microparticles containing this urethane resin had a nonuniform particle diameter and/or because the formation of the capsule form was unsatisfactory. In addition, the charging characteristics and stability of the toner particles were unsatisfactory in individual environments.

The reason for this is thought to be as follows. In an ordinary urethane formation reaction process, the diisocyanate component has been introduced in large amounts and the diol component has also been used in large amounts. When the diisocyanate component is decreased as in the present invention and a large amount of diol component is added as in the past, much unreacted diol component remains present. The molecular weight distribution of the obtained urethane resin ends up being broadened due to the influence of the residual diol component, and this is believed to cause the appearance of the ill effects cited above.

The present inventors achieved the present invention by controlling the amount of hydroxyl group present at the terminals of the urethane resin and thereby controlling the hydroxyl value per specific surface area of the produced toner particles and also by aligning the reactivity of the diol component. Here, the hydroxyl value per specific surface area of the toner particles is indicative of the quantity of hydroxyl groups present per surface area of the toner.

The toner obtained as described in the preceding is a toner comprising a toner particle that comprises at least (a) resin having polyester as the main component, colorant, wax, and (b) urethane resin, wherein the hydroxyl value per specific surface area of the toner particle is at least 0.5 mg KOH/$m^2$ and no more than 10.0 mg KOH/$m^2$, the toner has a Tg(0.5) of at least 40° C. and no more than 60° C. and a Tg(40)-Tg(0.5) of at least 2.0° C. and no more than 10.0° C., where Tg(0.5) is the glass transition temperature of the toner measured with a differential scanning calorimeter (DSC) at a rate of temperature rise of 0.5° C./min and Tg(4.0) is the glass transition temperature of the toner measured with the DSC at a rate of temperature rise of 4.0° C./min.

The toner of the present invention is a toner comprising a toner particle that comprises at least (a) resin having polyester as the main component, colorant, wax, and (b) urethane resin.

A toner particle having a sharp-melt property can be obtained in the present invention by the use of the (a) resin having polyester as the main component. In addition, a toner particle having a capsule-type structure and a uniformized particle size distribution can be produced by carrying out toner particle production using urethane resin (b) containing resin microparticles as the dispersant. This toner particle, when used as a toner particle for full color applications, can minimize differences in the quantity of charging caused by the colorants used, since the influence of the characteristics of the core portion in the capsule-type structure is strongly attenuated. In addition, by confining the wax in the core portion, this toner particle makes it possible to improve the toner particle flowability, inhibit deterioration in the durability of the development section, and restrain the load on cleaning.

The hydroxyl value per specific surface area of the toner particle preferably is at least 0.5 mg KOH/$m^2$ and no more than 10.0 mg KOH/$m^2$ and more preferably is at least 1.0 mg KOH/$m^2$ and no more than 8.0 mg KOH/$m^2$.

When the hydroxyl value per specific surface area of the toner particle is less than 0.5 mg KOH/$m^2$, the quantity of toner charging during image formation undergoes an increase at low humidities, which readily causes a low density and image defects. Again referring to the case of less than 0.5 mg KOH/$m^2$ for the hydroxyl value per specific surface area, it is difficult to achieve stable particle formation during toner particle granulation, which causes the particle size distribution to be scattered and thereby is prone to produce the problems of image defects and a nonuniform density.

When, on the other hand, the hydroxyl value per specific surface area of the toner particle exceeds 10.0 mg KOH/$m^2$, large variations occur in the quantity of toner charging under different environments, and in particular the quantity of charging is prone to be low in high-humidity environments. In addition, large variations in the quantity of toner charging are also prone to occur as a consequence of long-term standing. Moreover, large hydroxyl values, while increasing the stability during toner granulation, result in the stabilization of—and hence the presence of—particles with a relatively low particle size. This results in an increase in the quantity of fines and readily causes, for example, contamination of the members of the electrophotographic machine during development.

For example, the following methods can be used to adjust the aforementioned hydroxyl value per specific surface area of the toner particle.

(1) Controlling the hydroxyl value of the urethane resin (b), described below.

(2) Controlling the rotation rate of the emulsifying device in the emulsifying step, described below.

(3) Adapting the temperature and stirring conditions post-emulsification, described below.

Tactic (1), i.e., controlling the hydroxyl value of the urethane resin (b), is considered to be a particularly highly effective tactic for adjusting the aforementioned hydroxyl value per specific surface area of the toner particle.

The toner of the present invention has a Tg(0.5) of at least 40° C. and no more than 60° C., where Tg(0.5) is the glass transition temperature of the toner measured with a differential scanning calorimeter (DSC) at a rate of temperature rise of 0.5° C./min and Tg(4.0) is the glass transition temperature of the toner measured with the DSC at a rate of temperature rise of 4.0° C./min. This Tg(0.5) is preferably at least 42° C. and no more than 58° C.

When this Tg(0.5) is less than 40° C., the toner does exhibit an excellent low-temperature fixability, but the problems of wraparound and offset readily occur at high temperatures and the fixation temperature region is prone to be narrowed. The stability is also prone to be inadequate during image storage at high temperatures. On the other hand, the realization of low-temperature fixability by the toner is impaired when Tg(0.5) exceeds 60° C. In addition, while the toner particle does exhibit a satisfactory resistance to hot storage, this resistance to hot storage can also be achieved with such a toner particle that does not have a capsule structure, making the manifestation of a thermal advantage problematic.

The value of Tg(4.0)-Tg(0.5) is at least 2.0° C. and no more than 10.0° C. and preferably is at least 2.5° C. and no more than 8.0° C.

Capsulation of the toner particle is unsatisfactory when the value of Tg(4.0)-Tg(0.5) is less than 2.0° C.; other problems include an inadequate resistance to hot storage and a tendency for the wax and colorant to exert influence. On the other hand, when the value of Tg(4.0)-Tg(0.5) is larger than 10.0° C., capsulation of the toner particle is satisfactory, but the following problems can occur: low-temperature fixability by the toner may not appear; and wraparound on a fixing member tends to occur because exudation of the wax during fixing may be unsatisfactory. The values of Tg(0.5) and Tg(4.0)-Tg(0.5) can be adjusted into the ranges of the present invention by adjusting the condition of the surface layer (B). In specific terms, adjustment can be carried out through the viscosity and quantity of addition of the urethane resin (b) constituting the surface layer (B). In addition, the previously cited ranges can also be achieved by adjusting, for example, the concentration of the solution and its mixing ratio with the aqueous medium in the dispersion step that is an element of toner production.

The nitrogen content (N) of the toner particle surface used for the toner of the present invention, as measured by x-ray photoelectron spectroscopy (ESCA), is at least 0.5 atomic % but less than 7.0 atomic % and is preferably at least 1.0 atomic % but less than 7.0 atomic % and is more preferably at least 2.0 atomic % but less than 6.5 atomic %.

Establishing the nitrogen content (N) of the toner particle surface, as measured by x-ray photoelectron spectroscopy (referred to below as ESCA), in the range from 0.5 atomic % (inclusive) to less than 7.0 atomic % makes it possible to achieve stabilization not just of the fixing performance of the toner of the present invention, but also its resistance to hot storage and its triboelectric charging behavior. In particular, by having nitrogen-containing groups, with their high charge-providing ability, present concentrated at the toner particle surface, the triboelectric charging performance between toner particles is dramatically improved and a more stable capsule-type toner particle is provided.

Formation of the capsule-type toner particle in the present invention may be problematic when this nitrogen content (N) is less than 0.5 atomic %. As a consequence, the toner particles may readily agglomerate in a high-humidity, high-temperature environment (for example, 30° C./80% RH) or during long-term storage and a decline in the developing performance may tend to readily appear and image attenuation, such as blank dots on the image, may be facilitated. In addition, charge up is readily produced on the toner particles, which as a result tends to cause a decline in the density of the obtained visible image and tends to reduce the image quality, for example, image nonuniformity in the halftone regions.

When, on the other hand, this nitrogen content (N) is 7.0 atomic % or more, a reduction in charge quantity is readily produced, which is prone to cause fogging in the nonimage areas and/or phenomenon in which the toner drips from the developing device. In addition, due to a trend of increasing hardness (melting characteristics) for the urethane resin (b), cold offset tends to be easily caused when an on-demand fixing mechanism or a high-speed fixing mechanism is employed.

The previously cited range for the nitrogen content (N) can be satisfied by adjusting, for example, the quantity of urethane resin (b) addition and/or the urea group content in the urethane resin (b).

According to viscoelastic measurements, the maximum value for the loss elastic modulus G" of the toner of the present invention is preferably given at the temperature of 40° C. (inclusive) to 60° C. (inclusive) and more preferably at the temperature of 42° C. (inclusive) to 58° C. (inclusive).

In addition, the toner of the present invention preferably has a storage elastic modulus G' at 130° C. ($G'_{130}$) of at least $1.0\times10^3$ dN/m$^2$ and less than $1.0\times10^5$ dN/m$^2$. $G'_{130}$ is indicative of the elasticity at the fixing nip. There is a tendency for hot offset to be readily caused when $G'_{130}$ is less than $1.0\times10^3$ dN/m$^2$. On the other hand, when $G'_{130}$ is $1.0\times10^5$ dN/m$^2$ or more, the low-temperature fixability tends to decline. $G'_{130}$ is more preferably at least $3.0\times10^3$ dN/m$^2$ and no more than $5.0\times10^4$ dN/m$^2$.

The average circularity of the toner of the present invention is preferably from 0.970 (inclusive), to no more than 1.000. An excellent transfer efficiency is obtained when the average circularity of the toner is in this range. When, for example, the toner production method employs the solution suspension method, the average circularity can be controlled into the cited range by a spheronizing treatment in the slurry in this method. The average circularity of the toner is more preferably greater than or equal to 0.975 to less than or equal to 0.990.

The toner preferably has a weight-average particle diameter (D4) in the present invention of at least 4.0 μm to no more than 9.0 μm. This D4 is more preferably at least 4.5 μm to no more than 7.0 μm.

When the toner has a weight-average particle diameter in the cited range, charge up on the toner can be inhibited and image density can be well maintained even during long-term use. In addition, an excellent inhibition of scattering and dripping can be achieved in those instances in which, for example, a line image is output, and an excellent fine line reproducibility can be obtained.

The weight-average particle diameter (D4) of the toner can be adjusted into the previously cited range by controlling the quantity of addition of the urethane resin (b), infra, and the amount of incorporation of the oil phase and dispersion.

Toner particles of from 0.60 μm (inclusive) to 2.00 μm (inclusive) (also referred to hereafter as the quantity of fines in toner) are preferably no more than 2.0 number % of the toner of the present invention. A large quantity of fines less than or equal to 2.00 μm can easily become a strong contributor to the contamination of members during development and to variations in the quantity of charge for the toner and can readily cause problems such as a decline in density, fogging due to scattering, and so forth after long-term imaging. The quantity of fines in the toner is more preferably no greater than 1.5 number %.

Controlling the hydroxyl value per specific surface area of the toner particle is an example of an effective measure for reducing the quantity of fines in the toner. Specifically, it is thought that controlling the hydroxyl value per specific surface area of the toner particle promotes reaggregation during toner particle production, resulting in a decline in the stability of the fines in the aqueous dispersion and enabling a reduction in the quantity of fines in the toner.

The ratio D4/D1 of the weight-average particle diameter (D4) to the number-average particle diameter (D1) is preferably no greater than 1.25 for the toner of the present invention. A value no greater than 1.20 is more preferred. On the other hand, a D4/D1 value of at least 1.00 is also preferred.

The toner particle used by the present invention is particularly described in the following.

The toner particle used by the present invention comprises at least (a) resin having polyester as the main component, colorant, wax, and (b) urethane resin. The toner particle may therefore contain other additives on an optional basis in addition to the preceding.

The aforementioned resin (a) used by the present invention contains polyester as its main component. Here, "main component" indicates that the particular component makes up at least 50 mass % of the total amount of the resin (a). The polyester under consideration is preferably polyester that uses aliphatic diol as the main component of the alcohol component, and/or polyester that uses aromatic diol as the main component of the alcohol component.

This aliphatic diol preferably contains 2 to 8 carbons and more preferably contains 2 to 6 carbons.

The $C_{2-8}$ aliphatic diol can be exemplified by diols such as ethylene glycol, 1,2-propylene glycol, 1,3-propylene glycol, 1,4-butanediol, 1,5-pentanediol, 1,6-hexanediol, neopentyl glycol, 1,4-butenediol, 1,7-heptanediol, and 1,8-octanediol and by trihydric and higher hydric polyhydric alcohols such as glycerol, pentaerythritol, and trimethylolpropane. Preferred among the preceding are straight chain α,ω-alkanediols, wherein 1,4-butanediol and 1,6-hexanediol are more preferred. Moreover, viewed from the perspective of the durability, the aliphatic diol content in the alcohol component making up the polyester is preferably 30 to 100 mol % and more preferably is 50 to 100 mol %.

The aforementioned aromatic diol can be exemplified by polyoxypropylene(2.2)-2,2-bis(4-hydroxyphenyl)propane and polyoxyethylene(2.2)-2,2-bis(4-hydroxyphenyl)propane.

The carboxylic acid component making up the polyester under consideration can be exemplified by the following: aromatic polyvalent carboxylic acids such as phthalic acid, isophthalic acid, terephthalic acid, trimellitic acid, and pyromellitic acid; aliphatic polyvalent carboxylic acids such as fumaric acid, maleic acid, adipic acid, and succinic acid, as well as succinic acids substituted by $C_{1-20}$ alkyl or $C_{2-20}$ alkenyl, such as dodecenylsuccinic acid and octenylsuccinic acid; and the anhydrides of these acids and the alkyl($C_{1-8}$) esters of these acids.

Viewed from the perspective of the toner charging performance, the carboxylic acid preferably contains an aromatic polyvalent carboxylic acid compound and the content of this aromatic polyvalent carboxylic acid compound is preferably 30 to 100 mol % and more preferably 50 to 100 mol % of the carboxylic acid component making up the polyester.

Viewed from the perspective of the toner's charging performance, the starting monomer preferably contains trivalent and/or higher valent monomer, i.e., trihydric and/or higher hydric polyhydric alcohol and/or trivalent and/or higher valent polyvalent carboxylic acid compound.

There are no particular limitations on the method used to produce the polyester and known methods may be used. For example, production may be carried by the condensation polymerization at 180 to 250° C. of the alcohol component and carboxylic acid component in an inert gas atmosphere, optionally using an esterification catalyst.

The resin (a) preferably contains polyester that employs the aforementioned aliphatic diol as its alcohol component, as a main component. In contrast, a significant difference in the melting characteristics of this resin (a) is not seen even when the resin (a) contains polyester that uses bisphenol-type monomer for its alcohol component. However, a suitable polyester should be selected as appropriate due to the influence on the granulation characteristics in relation to the urethane resin (b).

The resin (a) may contain polyester resin other than polyester that employs aliphatic diol and/or aromatic diol as its alcohol component, for example, a polyester resin in which the amount of aliphatic diol used is outside the previously cited range, styrene-acrylic resin, polyester/styrene-acrylic mixed resin, epoxy resin, and so forth. In such cases, the content of polyester that uses the previously prescribed amount of aliphatic diol for its alcohol component is preferably at least 50 mass % with respect to the total amount of the resin (a) and more preferably is at least 70 mass %.

With regard to the molecular weight of the resin (a) in the present invention, in a preferred embodiment the peak molecular weight is no greater than 8,000 and more preferably is less than 5,500. In another preferred embodiment, the proportion for the molecular weight greater than or equal to 100,000 is no greater than 5.0% and more preferably is no greater than 1.0%.

A peak molecular weight for the resin (a) (=binder resin) in excess of 8,000 and/or a ratio of more than 5.0% for the molecular weight greater than or equal to 100,000, may have an effect on the toner's fixing performance, depending on the type and amount of the surface resin.

The ratio for the molecular weight less than or equal to 1000 for resin (a) is preferably no more than 10.0% in the present invention and more preferably is less than 7.0%. When the ratio for the molecular weight less than or equal to 1,000 for resin (a) is in the cited range, this can provide, due to the obtained thermal stability, an excellent inhibition of member contamination during development.

The production method as described below can be suitably used in the present invention in particular to bring the ratio for the molecular weight less than or equal to 1,000 to 10.0% or below.

In order to provide a small ratio for the molecular weight less than or equal to 1,000, for example, the ratio for the molecular weight less than or equal to 1,000 can be effectively reduced by dissolving the binder resin in solvent and bringing this solution into contact with water and holding. Specifically, this process elutes the aforementioned low molecular weight component (molecular weight not more than 1,000) into the water and can effectively remove this component from the resin solution.

For this reason, for example, the previously described solution suspension method is preferably used as the method of toner particle production. The low molecular weight component can be effectively removed by using a procedure in which the solution is brought into contact with aqueous medium and is held in this state prior to the suspension in the aqueous medium of the solution of the dissolved or dispersed resin (a), colorant, and wax.

Mixing resins having two or more different molecular weights may be used to adjust the toner molecular weight in the present invention.

Crystalline polyester may be present in the resin (a) in the present invention. The crystalline polyester is preferably resin obtained by the condensation polymerization of an alcohol component in which aliphatic diol is the main component, with a carboxylic acid component in which an aliphatic dicarboxylic acid compound is the main component.

This crystalline polyester is obtained using monomer containing an alcohol component comprising dihydric and/or higher hydric polyhydric alcohol and a carboxylic acid component comprising a divalent and/or higher valent polyvalent carboxylic acid compound. Preferred thereamong is resin obtained by the condensation polymerization of an alcohol component containing at least 60 mol % $C_{2-6}$ and preferably $C_{4-6}$ aliphatic diol, with a carboxylic acid component containing at least 60 mol % $C_{2-8}$, preferably $C_{4-6}$, and more preferably $C_4$ aliphatic dicarboxylic acid compound.

The aforementioned $C_{2-6}$ aliphatic diol making up the crystalline polyester under consideration can be exemplified by the following: ethylene glycol, 1,2-propylene glycol, 1,3-propylene glycol, 1,4-butanediol, 1,5-pentanediol, 1,6-hexanediol, neopentyl glycol, and 1,4-butenediol. Preferred thereamong are 1,4-butanediol and 1,6-hexanediol.

A polyhydric alcohol component other than aliphatic diol may be present in the alcohol component making up the crystalline polyester under consideration. This polyhydric alcohol component can be exemplified by the following: divalent aromatic alcohols, such as the alkylene ($C_{2-3}$) oxide adducts (average number of moles of addition=1 to 10) of bisphenol A, e.g., polyoxypropylene(2.2)-2,2-bis(4-hydroxyphenyl)propane and polyoxyethylene(2.2)-2,2-bis(4-hydroxyphenyl)propane; and also trihydric and higher hydric alcohols such as glycerol, pentaerythritol, trimethylolpropane, and so forth.

The $C_{2-8}$ aliphatic dicarboxylic acid compound making up the crystalline polyester under consideration can be exemplified by the following: oxalic acid, malonic acid, maleic acid, fumaric acid, citraconic acid, itaconic acid, glutaconic acid, succinic acid, adipic acid, the anhydrides of these acids, and the alkyl($C_{1-3}$) esters of these acids. Fumaric acid and adipic acid are preferred among the preceding, and fumaric acid is more preferred.

A polyvalent carboxylic acid component other than the aliphatic dicarboxylic acid compound may be present in the carboxylic acid component making up the crystalline polyester under consideration. This polyvalent carboxylic acid component can be exemplified by the following: aromatic dicarboxylic acids such as phthalic acid, isophthalic acid, terephthalic acid, and so forth; aliphatic dicarboxylic acids such as sebacic acid, azelaic acid, n-dodecylsuccinic acid, and n-dodecenylsuccinic acid; alicyclic dicarboxylic acids such as cyclohexanedicarboxylic acid and so forth; trivalent and higher valent polyvalent carboxylic acids such as trimellitic acid, pyromellitic acid, and so forth; the anhydrides of these acids; and the alkyl($C_{1-3}$) esters of these acids.

The alcohol component and carboxylic acid component constituting the crystalline polyester under consideration can be subjected to condensation polymerization by, for example, reaction at 150 to 250° C. in an inert gas atmosphere, as necessary using an esterification catalyst and so forth.

The wax using in the present invention can be exemplified by the following: aliphatic hydrocarbon waxes such as low molecular weight polyethylenes, low molecular weight polypropylenes, low molecular weight olefin copolymers, microcrystalline waxes, paraffin waxes, and Fischer-Tropsch waxes; oxides of aliphatic hydrocarbon waxes, such as oxidized polyethylene wax; waxes having an aliphatic acid ester as the main component, such as aliphatic hydrocarbon-type ester waxes; waxes obtained by the partial or complete deacidification of an aliphatic acid ester, such as deacidified carnauba wax; partial esters between aliphatic acids and polyhydric alcohols, such as monoglyceryl behenate; and hydroxyl-functional methyl ester compounds obtained by the hydrogenation of plant oils and fats.

Esters waxes are particularly preferred for use in the present invention for the ease of preparation of the wax dispersion in the solution suspension method, the ease of incorporation into the prepared toner, and the exudation behavior from the toner during fixing, and their release characteristics.

The ester wax used in the present invention has at least one ester bond in each molecule, and natural ester waxes and synthetic ester waxes may be used.

The synthetic ester waxes can be exemplified by monoester waxes synthesized from straight-long-chain saturated aliphatic acids and straight-long-chain saturated alcohols. The straight-long-chain saturated aliphatic acid used is preferably represented by the general formula $C_nH_{2n+1}COOH$ where n is about 5 to 28. The straight-long-chain saturated alcohol used is preferably represented by the general formula $C_nH_{2n+1}OH$ where n is about 5 to 28.

The straight-long-chain saturated aliphatic acid can be specifically exemplified by caprylic acid, undecylic acid, lauric acid, tridecylic acid, myristic acid, palmitic acid, pentadecylic acid, heptadecanoic acid, tetradecanoic acid, stearic acid, nonadecanoic acid, arachic acid, behenic acid, lignoceric acid, cerotic acid, heptacosanoic acid, montanic acid, and melissic acid.

The straight-long-chain saturated alcohol, on the other hand, can be specifically exemplified by amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol.

Ester waxes having two or more ester bonds in each molecule can be exemplified by trimethylolpropane tribehenate, pentaerythritol tetrabehenate, pentaerythritol diacetate dibehenate, glycerol tribehenate, 1,18-octadecanediol bisstearate, and polyalkanol esters (tristearyl trimellitate, distearyl maleate.)

The natural ester waxes can be exemplified by candelilla wax, carnauba wax, rice wax, Japanese wax, jojoba oil, beeswax, lanolin, castor wax, montan wax, and derivatives of the preceding.

Modified waxes in addition to the preceding can be exemplified by polyalkanoic acid amides (ethylenediamine dibehenylamide), polyalkylamides (tristearylamide of tri-mellitic acid), and dialkyl ketones (distearyl ketone).

These waxes may be partially saponified.

More preferred among the preceding are synthetic ester waxes from straight-long-chain saturated aliphatic acids and straight-long-chain saturated aliphatic alcohols as well as natural waxes having such esters as their main component.

The reason for this is not clear, but it is thought to be due to the high mobility in the melt state when the wax has a straight-chain structure. That is, during fixing, the wax must exude to the toner surface layer by passing through substances that exhibit a relatively high polarity, i.e., the polyester binder resin and the diol/diisocyanate reaction product of the surface layer. It is therefore thought that a wax having a straight-chain structure to the greatest extent possible is advantageous for passing through these highly polar substances.

In addition to the straight-chain structure described above, the ester is more preferably a monoester in the present invention. For the same reason as elaborated above, the present inventors presume that a bulky structure, as when an ester is bonded in each of several branch chains, may experience great difficulty passing through highly polar substances, such as the polyester and the surface layer of the present invention, and exuding to the surface.

The optional co-use of a hydrocarbon wax other than an ester wax is also a preferred embodiment in the present invention.

This hydrocarbon wax other than an ester wax can be exemplified by petroleum-based natural waxes such as paraffin waxes, microcrystalline waxes, petrolatum, and derivatives thereof; synthetic hydrocarbons such as Fischer-Tropsch waxes, polyolefin waxes and derivatives thereof (polyethylene wax, polypropylene wax); and natural waxes such as ozokerite and sericin.

The wax content in the toner in the present invention is preferably 5.0 to 20.0 mass % and more preferably is 5.0 to 15.0 mass %. The toner does not retain its releasability at less than 5.0 mass %, while at more than 20.0 mass % the wax is prone to be exposed at the toner surface, which creates the risk of causing a reduction in the resistance to hot storage.

In the present invention, the wax preferably has a peak temperature for the highest endothermic peak, measured by differential scanning calorimetry (DSC), in the range from 60° C. (inclusive) to 90° C. (inclusive). When the peak temperature of the highest endothermic peak is in the cited range, an excellent exudation by the wax to the toner surface during fixing is obtained and an even better low-temperature fixability and offset resistance are thereby obtained. In addition, an excellent enclosure of the wax in the toner can be carried out, enabling an even better maintenance of the resistance to hot storage.

Examples of the colorant used in the present invention are provided below.

Yellow colorants can be exemplified by compounds such as condensed azo compounds, isoindolinone compounds, anthraquinone compounds, azo metal complexes, methine compounds, and arylamide compounds.

The following are specific examples: C.I. Pigment Yellow 12, 13, 14, 15, 17, 62, 74, 83, 93, 94, 95, 97, 109, 110, 111, 120, 128, 129, 138, 147, 150, 151, 154, 155, 168, 180, 185, 213, and 214. A single one of these may be used or two or more may be used in combination.

Magenta colorants can be exemplified by condensed azo compounds, diketopyrrolopyrrole compounds, anthraquinones, quinacridone compounds, basic dye lake compounds, naphthol compounds, benzimidazolone compounds, thioindigo compounds, and perylene compounds.

The following are specific examples: C.I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, 269, and C.I. Pigment Violet 19. A single one of these may be used or two or more may be used in combination.

Cyan colorants can be exemplified by copper phthalocyanine compounds and their derivatives, anthraquinone compounds, and basic dye lake compounds.

The following are specific examples: C.I. Pigment Blue 1, 7, 15, 15:1, 15:2, 15:3, 15:4, 60, 62, and 66. A single one of these may be used or two or more may be used in combination.

Black colorants can be exemplified by carbon blacks such as furnace black, channel black, acetylene black, thermal black, and lamp black. Metal oxides such as magnetite and ferrite may also be used.

When a strongly water-soluble dye or pigment is used as the colorant in the present invention, it will end up dissolving in the water used during the production sequence, which can make it difficult to obtain an excellent granulation and can prevent the appearance of the desired coloring power.

With respect to the use in the present invention as a colorant for ordinary color toners, the colorant content is preferably at least 2.0 mass % with respect to the toner and no more than 15.0 mass % with respect to the toner. The coloring power declines at less than 2.0 weight %. On the other hand, the color space tends to be small at more than 15.0 weight %. At least 2.5 mass % and no more than 12.0 mass % is more preferred.

The toner of the present invention can preferably also be used as a reduced-density pale-color toner in addition to ordinary color toners. In this case, the colorant content is preferably at least 0.5 mass % and no more than 5.0 mass % with respect to the toner. At least 0.7 mass % and no more than 3.0 mass % is more preferred.

The number-average particle diameter of the colorant, in the toner particle image obtained by taking an enlarged photograph of the toner particle cross section, is preferably no greater than 200 nm. No greater than 150 nm is more preferred. On the other hand, this number-average particle diameter is preferably at least 50 nm. At above 200 nm, the grain aggregates are large and the formation of a colorant shell is impaired. This can readily cause a reduction in the coloring power and a reduction in the color gamut.

A charge control agent may be used in the present invention on an optional basis. The charge control agent may be present in the toner particle comprising at least the resin (a), colorant, and wax, or may be present in the surface layer (B) described below.

The known charge control agents can be used as the charge control agent in the present invention, and examples are as follows.

Negative-type charge control agents can be exemplified by metal compounds of aromatic carboxylic acids such as salicylic acid, alkylsalicylic acid, dialkylsalicylic acid, naphthoic acid, and dicarboxylic acids; the metal salts and metal complexes of azo dyes and azo pigments; polymer compounds that have a sulfonic acid group or carboxylic acid group in side chain position; boron compounds; urea compounds; silicon compounds; calixarene; and so forth. The positive-type charge control agents can be exemplified by quaternary ammonium salts, polymer compounds having a quaternary ammonium salt in side chain position, guanidine compounds, nigrosin compounds, and imidazole compounds.

The urethane resin (b) used in the present invention will now be considered.

The aforementioned urethane resin (b) comprises the prepolymer reaction product of a diol component and a diisocyanate component. Resins having different functionalities can be obtained by adjusting this diol component and diisocyanate component.

Examples of the diisocyanate component are as follows: $C_{6-20}$ (here and hereafter, this excludes the carbon in the NCO group) aromatic diisocyanates, $C_{2-18}$ aliphatic diisocyanates, $C_{4-15}$ alicyclic diisocyanates, $C_{8-15}$ aromatic hydrocarbon diisocyanates, modifications of these diisocyanates (modifications that contain the urethane group, carbodiimide group, allophanate group, urea group, biuret group, uretdione group, uretimine group, isocyanurate group, or oxazolidine group; also referred to hereafter as modified diisocyanates), and mixtures of two or more of the preceding.

The aforementioned aromatic diisocyanates can be exemplified by the following: 1,3-phenylene diisocyanate, 1,4-phenylene diisocyanate, 1,5-naphthylene diisocyanate, 2,4-tolylene diisocyanate, 2,6-tolylene diisocyanate (TDI), crude TDI, 2,4'-diphenylmethane diisocyanate, 4,4'-diphenylmethane diisocyanate (MDI), and crude MDI [crude diaminophenylmethane {condensation product of formaldehyde and aromatic amine (aniline) or a mixture thereof}].

The aforementioned aliphatic diisocyanates can be exemplified by the following: ethylene diisocyanate, tetramethylene diisocyanate, hexamethylene diisocyanate (HDI), dodecamethylene diisocyanate, 1,6,11-undecanetriisocyanate, 2,2,4-trimethylhexamethylene diisocyanate, lysine diisocyanate, 2,6-diisocyanatomethyl caproate, bis(2-isocyanatoethyl) fumarate, bis(2-isocyanatoethyl) carbonate, and 2-isocyanatoethyl-2,6-diisocyanatohexanoate.

The aforementioned alicyclic diisocyanates can be exemplified by the following: isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornane diisocyanate, and 2,6-norbornane diisocyanate.

The aforementioned aromatic hydrocarbon diisocyanates can be exemplified by the following: m-xylylene diisocyanate, p-xylylene diisocyanate (XDI), $\alpha,\alpha,\alpha',\alpha'$-tetramethylxylylene diisocyanate (TMXDI).

The aforementioned modified diisocyanates can be exemplified by the following: modifications of the isocyanate such as modified MDI (urethane-modified MDI, carbodiimide-modified MDI, trihydrocarbyl phosphate-modified MDI), urethane-modified TDI, and so forth, and mixtures of two or more of the preceding (for example, modified MDI is used with urethane-modified TDI (isocyanate-containing prepolymer)).

Preferred among the preceding are $C_{6-15}$ aromatic diisocyanates, $C_{4-12}$ aliphatic diisocyanates, and $C_{4-15}$ alicyclic diisocyanates, wherein TDI, MDI, HDI, hydrogenated MDI, and IPDI are particularly preferred.

Trifunctional and/or higher functional isocyanate compounds can also be used for the urethane resin (b) in addition to the aforementioned diisocyanate component. These trifunctional and higher functional isocyanate compounds can be exemplified by polyarylpolyisocyanate (PAPI), 4,4',4"-triphenylmethane triisocyanate, m-isocyanatophenylsulfonyl isocyanate, and p-isocyanatophenylsulfonyl isocyanate.

The diol component that can be used for the urethane resin (b) can be exemplified by the following: alkylene glycols (ethylene glycol, 1,2-propylene glycol, 1,3-propylene glycol, 1,4-butanediol, 1,6-hexanediol, octanediol, decanediol, dodecanediol, tetradecanediol, neopentyl glycol, 2,2-diethyl-1,3-propanediol); alkylene ether glycols (diethylene glycol, triethylene glycol, dipropylene glycol, polyethylene glycol, polypropylene glycols, polytetramethylene ether glycol); alicyclic diols (e.g., 1,4-cyclohexanedimethanol, hydrogenated bisphenol A); bisphenols (e.g., bisphenol A, bisphenol F, bisphenol S); the alkylene oxide (e.g., ethylene oxide, propylene oxide, butylene oxide) adducts of the previously described alicyclic diols; the alkylene oxide (e.g., ethylene oxide, propylene oxide, butylene oxide) adducts of the previously described bisphenols; as well as polylactone diols (poly-ε-caprolactone diol) and polybutadiene diols. The alkyl moiety of the aforementioned alkylene ether glycols may be straight chain or branched. Alkylene glycols with a branched structure may also preferably be used in the present invention.

When the solubility (affinity) with respect to ethyl acetate is taken into consideration, the use is preferred among the preceding of the compounds having alkyl structures and preferably $C_{2-12}$ alkylene glycols.

In addition to the diol component described above, polyester oligomers in which the terminals are hydroxyl groups (terminal diol polyester oligomers) can also be used as a suitable diol component for the urethane resin under consideration.

The molecular weight (number-average molecular weight) of such a terminal diol polyester oligomer is preferably no greater than 3000 and more preferably is at least 800 and no more than 2000.

When the molecular weight of the terminal diol polyester oligomer is greater than the preceding, the reactivity with isocyanate-terminated compounds is diminished and the properties of the polyester will be overly expressed and solubility in ethyl acetate will end up appearing.

The content of the terminal diol polyester oligomer in the monomer constituting the reaction product of the diol component and diisocyanate component is preferably at least 1 mol % and no more than 10 mol % and is more preferably at least 3 mol % and no more than 6 mol %.

When the terminal diol polyester oligomer content exceeds 10 mol %, the reaction product of the diol component and diisocyanate component may end up being soluble in ethyl acetate.

When, on the other hand, the terminal diol polyester oligomer is less than 1 mol %, the reaction product of the diol component and diisocyanate component becomes overly thermally immobilized, which may affect the fixing performance; in addition, the affinity with the resin (a) is reduced, which may have an effect on the formation of the surface layer.

The polyester skeleton of the terminal diol polyester oligomer is preferably the same as the polyester skeleton of the resin (a) in order to form a high-quality capsule-type toner particle. This is related to the affinity between the toner base particle (core) and the reaction product of the diol component and diisocyanate component of the surface layer.

The previously described terminal diol polyester oligomer may be modified with, for example, ethylene oxide or propylene oxide, and thus may contain the ether bond.

A compound in which a reaction product of an amino compound and an isocyanate compound is urea bonded may also be co-used for the urethane resin and present in addition to the reaction product of the diol component and diisocyanate component.

The aforementioned amine compound can be exemplified by the following: diamines such as diaminoethane, diaminopropane, diaminobutane, diaminohexane, piperazine, 2,5-dimethylpiperazine, amino-3-aminomethyl-3,5,5-trimethylcyclohexane (isophoronediamine, IPDA), 4,4'-diaminodicyclohexylmethane, 1,4-diaminocyclohexane, aminoethylethanolamine, hydrazine, hydrazine hydrate, and so forth; as well as triamines such as triethylamine, diethylenetriamine, 1,8-diamino-4-aminomethyloctane, and so forth.

Besides the preceding, the reaction product of an isocyanate compound and a compound having a group in which highly reactive hydrogen is present (e.g., carboxylic acid group, cyano group, thiol group), may also be co-used for the urethane resin under consideration.

The urethane resin may have the carboxylic acid group, sulfonic acid group, carboxylate salt group, or sulfonate salt group in side chain position. This facilitates formation of the aqueous dispersion and is also effective for forming a stable capsule-type structure without dissolution in the solvent of the oil phase. These can be easily produced by introducing a carboxylic acid group, sulfonic acid group, carboxylate salt group, or sulfonate salt group into side chain position on the diol component or diisocyanate component.

Diol component in which the carboxylic acid group or carboxylate salt group has been introduced in side chain position can be exemplified by dihydroxycarboxylic acids such as dimethylolacetic acid, dimethylolpropionic acid, dimethylolbutanoic acid, dimethylolbutyric acid, dimethylolpentanoic acid, and so forth, and by their metal salts.

Diol component in which the sulfonic acid group or sulfonate salt group has been introduced in side chain position can be exemplified by sulfoisophthalic acid and N,N-bis(2-hydroxyethyl)-2-aminoethanesulfonic acid and by their metal salts.

The content of this diol component having the carboxylic acid group, sulfonic acid group, carboxylate salt group, or sulfonate salt group introduced in side chain position is preferably at least 1.0 mol % and no more than 50 mol % and more preferably is at least 20 mol % and no more than 30 mol %, in each case with respect to the total monomer that forms the reaction product of the diol component and diisocyanate component.

When this diol component is less than 10 mmol. %, the dispersibility of the resin microparticles, described below, is prone to become poor and the granulatability may be impaired. When, on the other hand, 50 mol % is exceeded, the reaction product of the diol component and diisocyanate component will dissolve in the aqueous medium and the dispersant function will not be fulfilled.

The urethane resin (b) used by the present invention will now be more particularly described.

Designating Tg(0.5)(b) to be the glass transition temperature of the urethane resin (b) used by the present invention, as measured with a differential scanning calorimeter (DSC) at a rate of temperature rise of 0.5° C., this Tg(0.5) (b) is preferably larger than Tg(0.5)(a), which is the glass transition temperature of the resin (a) measured at a rate of temperature rise of 0.5° C. As a consequence, control of the monomer type, molecular weight, and branch structure is preferably used in order to bring the glass transition temperature of the resin (b), designated as Tg(b), to the prescribed value. Tg(0.5) (b) is preferably at least 50° C. and no more than 100° C. and more preferably is at least 55° C. and no more than 90° C. This makes it possible to obtain a toner that exhibits a satisfactory resistance to hot storage and that has little tendency to exert an influence on the fixing performance.

The urethane resin (b) used in the present invention preferably has a hydroxyl value of at least 10 mg KOH/g and no more than 200 mg KOH/g and more preferably of at least 20 mg KOH/g and no more than 150 mg KOH/g. The hydroxyl value of the urethane resin can be adjusted by adjusting the blending amounts (molar ratio) for the divol component and diisocyanate component and/or by introducing a monoisocyanate, monofunctional alcohol, or trifunctional and/or higher functional alcohol.

Designating [OH] as the total number of moles of diol component in the urethane resin (b) and [NCO] as the total number of moles of diisocyanate component in the urethane resin (b), [NCO]/[OH] for the urethane resin (b) is preferably at least 0.5 and no more than 1.0 and more preferably is at least 0.5 and no more than 0.9. The number-average molecular weight (Mn) of the tetrahydrofuran (THF)-soluble matter in the urethane resin (b) is preferably at least 1000 and no more than 5000 and Mw/Mn is preferably no greater than 10.0.

When [NCO]/[OH] is larger than 1.0, the terminals of the urethane resin under consideration will be NCO terminals and control of the amount of tetrahydrofuran (THF)-soluble matter, the molecular weight, and the molecular weight distribution for the urethane resin (b) may be impaired. Thus, the tetrahydrofuran (THF)-soluble matter may be less than 80 mass %, Mn of the urethane resin (b) may be larger than 5000, and/or Mw/Mn for the resin (b) may become larger than 10.0. Moreover, oligomerization reactions of the starting isocyanate, such as dimerization and trimerization, may occur, making it difficult to obtain the desired molecular weight and molecular weight distribution for the resin (b).

When, on the other hand, [NCO]/[OH] is less than 0.5, it may not be possible to satisfy the combination of molecular weight characteristics sought for the urethane resin (b). For example, Mn of the urethane resin (b) may be smaller than 1000, and/or, even if Mn is at least 1000 and no more than 5000, Mw/Mn may be larger than 10.0.

The toner particles used by the present invention are preferably capsule-type toner particles that have a surface layer (B) having the previously described urethane resin (b) as the main component, on the surface of a toner base particle (A) comprising at least colorant, wax, and the (a) resin having polyester as the main component. This surface layer (B) is preferably formed by resin microparticles that comprise the previously described urethane resin (b) and that have a number-average particle diameter of at least 30 nm and no more than 150 nm.

The method of producing these resin microparticles is not particularly limited and emulsion polymerization method or a production method in which the resin is converted into a liquid form by melting or dissolution in solvent and granulation is then effected by suspending this in an aqueous medium may be used.

The surface layer (B) in the present invention preferably contains at least 70 mass % urethane resin (b). In addition, the surface layer (B) can be elaborated by using combinations of different types of urethane resins (b).

When the proportion taken up by the urethane resin (b) is less than 70 mass %, this may exert an influence on the average circularity of the toner particles and on the standard deviation on the toner particle circularity—even if the urethane resin (b) has the desired amount of THF-soluble matter and has the desired molecular weight characteristics. A more preferred range for the proportion taken up by the urethane resin (b) is at least 80 mass % and an even more preferred range is at least 90 mass %.

The resin microparticles comprising the urethane resin (b) can be produced using a known surfactant and/or dispersant, or a self-emulsification functionality can be imparted to the resin that constitutes the resin microparticles.

There are no particular limitations on the usable solvents when the resin microparticles are produced by dissolving the resin in solvent, and this solvent can be exemplified by the following: hydrocarbon solvents such as ethyl acetate, xylene, hexane, and so forth; halogenated hydrocarbon solvents such as methylene chloride, chloroform, dichloroethane, and so forth; ester solvents such as methyl acetate, ethyl acetate, butyl acetate, isopropyl acetate, and so forth; ether solvents such as diethyl ether and so forth; ketone solvents such as acetone, methyl ethyl ketone, diisobutyl ketone, cyclohexanone, methylcyclohexane, and so forth; and alcohol solvents such as methanol, ethanol, butanol, and so forth.

With regard to the production of the aforementioned resin microparticles, a preferred embodiment is a production method that uses resin microparticles comprising a reaction product of the diol component and diisocyanate component as the dispersant. In this production method, a prepolymer having the diisocyanate component is produced; this is rapidly dispersed in water; and the diol component is then added and chain elongation or crosslinking is carried out.

Thus, the prepolymer having the diisocyanate component and as necessary other required components are dissolved or dispersed in a solvent that, among the previously cited solvents, exhibits a high solubility in water, e.g., acetone or an alcohol. By introducing this into water, the prepolymer having the diisocyanate component is rapidly dispersed. Then, the aforementioned diol component is added and a reaction product of the diol component and diisocyanate component having the desired properties is produced.

With regard to the particle diameter of the resin microparticles comprising the urethane resin (b), the number-average particle diameter is preferably at least 30 nm and no more than 150 nm in order for the toner particle to form a capsule structure.

Thus, the granulation stability of the toner particles tends to be low when the number-average particle diameter is less than 30 nm. As a result, there is an effect on the formation of the capsule structure and the toner's resistance to hot storage tends to be lowered.

When, on the other hand, the number-average particle diameter is larger than 150 nm, the dispersibility in the aqueous phase in toner particle granulation is impaired, and there is a tendency for particles to aggregate with each other and/or for irregular particle shapes to be produced.

A convenient method of producing the toner particle used in the present invention is described in the following, but there is no limitation to this.

The toner particle is preferably produced as follows: at least the (a) resin having polyester as the main component, the colorant and the wax are dissolved or dispersed in an organic medium to obtain a solution or dispersion (also referred to below as the oil phase); the obtained solution or dispersion is dispersed in an aqueous medium in which resin microparticles comprising the aforementioned (b) urethane resin are dispersed (also referred to below as the aqueous phase); and the solvent is removed from the obtained dispersion by drying.

In this system, the resin microparticles also function as a dispersant when the solution or dispersion (oil phase) is suspended in the aqueous phase. A step of cohesion to the toner surface is rendered unnecessary by toner particle production by the method under consideration and a capsule-type toner particle can be conveniently produced as a result.

The organic solvent that dissolves, inter alia, the resin (a) in the above-described method of producing the oil phase can be exemplified by the following: hydrocarbon solvents such as ethyl acetate, xylene, hexane, and so forth; halogenated hydrocarbon solvents such as methylene chloride, chloroform, dichloroethane, and so forth; ester solvents such as methyl acetate, ethyl acetate, butyl acetate, isopropyl acetate, and so forth; ether solvents such as diethyl ether and so forth;

and ketone solvents such as acetone, methyl ethyl ketone, diisobutyl ketone, cyclohexanone, methylcyclohexane, and so forth.

The resin (a) is preferably used in the form of a resin dispersion dissolved in the previously described organic solvent. In this case, and considering the ease of production in the ensuing step, the resin (a) is preferably blended in the range of 40 mass % to 60 mass % as the resin component in the organic solvent, although this will vary with the viscosity and solubility of the resin. Heating at up to the boiling point of the organic solvent during dissolution is preferred in order to enhance the resin's solubility.

The wax and colorant are also preferably put into a dispersed state in the aforementioned organic solvent. Thus, a wax dispersion and a colorant dispersion are preferably respectively produced by preliminarily subjecting the wax and colorant to mechanical grinding by a wet or dry method and then dispersing the wax and colorant in organic solvent to produce the respective dispersions.

The dispersibility of the wax and colorant can also be improved by the addition of resin and dispersant matched to each. These can be selected and used in accordance with the circumstances, since they vary as a function of the wax, colorant, resin, and organic solvent used. In particular, the colorant is preferably used after it has been preliminarily dispersed in the organic solvent in combination with the resin (a).

The aforementioned oil phase can be prepared by blending desired quantities of the resin dispersion, wax dispersion, colorant dispersion, and organic solvent and dispersing these individual components in the organic solvent.

The aqueous medium may be water by itself, but water may be used in combination with a water-miscible solvent. This water-miscible solvent can be exemplified by alcohols (methanol, isopropanol, ethylene glycol), dimethylformamide, tetrahydrofuran, cellosolves (methylcellosolve), and lower ketones (acetone, methyl ethyl ketone). In a preferred method, a suitable quantity of the organic solvent used for the oil phase is preliminarily mixed into the aqueous medium used by the present invention. This is believed to have the effects of raising the liquid droplet stability during granulation and of facilitating suspension between the aqueous medium and oil phase.

The resin microparticles comprising the urethane resin (b) are preferably used in the present invention by dispersing these resin microparticles in the aqueous medium. The resin microparticles comprising the urethane resin (b) are used by blending the desired amount in view of the stability of the oil phase in the ensuing step and capsulation of the toner base particles. For the use of the resin microparticles to form the surface layer (B), the quantity of resin microparticle use in the present invention is preferably at least 2.0 mass parts and no more than 15.0 mass parts per 100 mass parts of the toner base particle (A). Thus, the surface layer (B) is preferably at least 2.0 mass % and no more than 15.0 mass % with respect to the toner base particle (A). Capsulation may be affected at less than 2.0 mass %. At more than 15.0 mass %, the properties of the surface layer (B) tend to also be strongly reflected during fixing. At least 3.0 mass % and no more than 14.0 mass % is more preferred, while at least 4.0 mass % and no more than 1.2.0 mass % is even more preferred.

A known surfactant, dispersant, dispersion stabilizer, water-soluble polymer, or viscosity regulator may also be added to the aqueous medium.

This surfactant can be exemplified by anionic surfactants, cationic surfactants, amphoteric surfactants, and nonionic surfactants. These may be freely selected in view of the polarity during toner particle production.

Specific examples are as follows: anionic surfactants such as alkylbenzenesulfonate salts, α-olefinsulfonate salts, phosphate esters, and so forth; cationic surfactants such as alkylamine salts and amine salt forms of, e.g., amino alcohol aliphatic acid derivatives, polyamine aliphatic acid derivatives, and imidazoline, as well as quaternary ammonium salt types such as alkyltrimethylammonium salts, dialkyldimethylammonium salts, alkyldimethylbenzylammonium salts, pyridinium salts, alkylisoquinolinium salts, benzethonium chloride, and so forth; nonionic surfactants such as aliphatic acid amide derivatives and polyhydric alcohol derivatives; and amphoteric surfactants such as alanine, dodecyldi(aminoethyl)glycine, di(octylaminoethyl)glycine, N-alkyl-N,N-dimethylammonium betaine, and so forth.

The aforementioned dispersant can be exemplified by the following: acids such as acrylic acid, methacrylic acid, α-cyanoacrylic acid, α-cyanomethacrylic acid, itaconic acid, crotonic acid, fumaric acid, maleic acid, and maleic anhydride; hydroxyl-functional (meth)acrylic-type monomers, e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, the monoacrylate ester of diethylene glycol, the monomethacrylate ester of diethylene glycol, the monoacrylate ester of glycerol, the monomethacrylate ester of glycerol, N-methylolacrylamide, N-methylolmethacrylamide, and so forth; vinyl alcohol and ethers of vinyl alcohol, e.g., vinyl methyl ether, vinyl ethyl ether, vinyl propyl ether, and so forth; esters between vinyl alcohol and carboxyl-functional compounds, e.g., vinyl acetate, vinyl propionate, vinyl butyrate, and so forth; acrylamide, methacrylamide, and diacetone acrylamide and their methylolation products; acid chlorides such as acryloyl chloride, methacryloyl chloride, and so forth; the homopolymers and copolymers of nitrogenous monomers or nitrogenous heterocyclic monomers, e.g., vinylpyridine, vinylpyrrolidone, vinylimidazole, ethyleneimine, and so forth; polyoxyethylenes, e.g., polyoxyethylene, polyoxypropylene, polyoxyethylene alkylamine, polyoxypropylene alkylamine, polyoxyethylene alkylamide, polyoxypropylene alkylamide, polyoxyethylene nonylphenyl ether, polyoxyethylene laurylphenyl ether, polyoxyethylene stearylphenyl ester, polyoxyethylene nonylphenyl ester, and so forth; and celluloses such as methyl cellulose, hydroxyethyl cellulose, hydroxypropyl cellulose, and so forth.

When such a dispersant is used, the dispersant may be allowed to remain on the surface of the toner particle; however, viewed from the perspective of toner charging it is preferably removed by dissolution/washing.

A solid dispersion stabilizer may be used in the present invention from the standpoint of maintaining a more desirable state of dispersion.

The use of a dispersion stabilizer is preferred in the present invention. The reason for this is as follows. A high viscosity is evidenced by the organic medium in which the resin (a) (main component of the toner) has been dissolved. The dispersion stabilizer surrounds the circumference of the oil droplets, which have been formed by the microfine dispersion of the organic medium by high shear force, and thus brings about stabilization by preventing the oil droplets from re-coalescing with each other.

This dispersion stabilizer can be an inorganic dispersion stabilizer or an organic dispersion stabilizer. When an inorganic dispersion stabilizer is used, an inorganic dispersion stabilizer is preferably used that can be removed with an acid (e.g., hydrochloric acid) that is not compatible with the solvent, since the toner particles undergo granulation with the inorganic dispersion stabilizer attached on the particle surface post-dispersion. Usable inorganic dispersion stabilizers can be exemplified by the following: calcium carbonate, calcium chloride, sodium bicarbonate, potassium bicarbonate, sodium hydroxide, potassium hydroxide, hydroxyapatite, and calcium triphosphate.

There are no particular limitations on the dispersion method used during toner particle production, and a general-purpose apparatus may be used, based, for example, on low speed shear, high speed shear, friction, a high pressure jet, ultrasound, and so forth. However, the use of high speed shear is preferred in order to bring the dispersion particle diameter to approximately 2 to 20 μm.

There are no particular limitations other than this is a stirring device equipped with rotating blades or paddles, and any device in ordinary use as an emulsifying device or dispersing device can be used for the dispersion method under consideration. Examples are continuous emulsifying devices such as the Ultra-Turrax (IKA), Polytron (Kinematics), TK Auto Homo Mixer (Tokushu Kika Kogyo Kabushiki Kaisha), Ebara Milder (Ebara Corporation), TK Homomic Line Flow (Tokushu Kika Kogyo Kabushiki Kaisha), Colloid Mill (Shinko Pantech), Slusher and Trigonal Wet Pulverizer (Mitsui Miike Kakoki Co., Ltd.), Cavitron (Eurotek Inc.), and Fine Flow Mill (Taiheiyo Kiko Co., Ltd.), as well as batch/continuous dual-use emulsifying devices such as the Clearmix (M Technique Co., Ltd.) and Filmics (Tokushu Kika Kogyo Kabushiki Kaisha).

There is no particular limitation on the rotation rate when a dispersing device based on high speed shear is employed in the dispersion method under consideration, and 1000 to 30000 rpm is generally used and 3000 to 20000 rpm is preferred.

The dispersion time in the dispersion method under consideration is generally 0.1 to 5 minutes in the case of batch modes. The temperature during dispersion is generally 10 to 150° C. (under an overpressure) and is preferably 10 to 100° C.

In order to remove the organic solvent from the obtained dispersion, a method can be used in which the temperature of the system as a whole is gradually raised and the organic solvent in the liquid droplets is completely removed by evaporation.

Alternatively, the dispersion may be sprayed into a drying atmosphere in order to form toner particles by completely removing the non-water-soluble organic solvent in the liquid droplets, while at the same time evaporating off the water in the dispersion.

In this case, the drying atmosphere into which the dispersion is sprayed generally is a gas yielded by heating, for example, air, nitrogen, carbon dioxide, or combustion gas, and in particular is a gas current heated to a temperature that is at least as high as the boiling point of the highest boiling solvent used. The sought-after quality is fully achieved even by a brief treatment with, for example, a spray dryer, belt dryer, rotary kiln, and so forth.

In those instances in which the dispersion obtained by the dispersion method under consideration has a broad particle size distribution and this particle size distribution is maintained during the washing and drying treatments, the particle size distribution can be adjusted by classification to the desired particle size distribution.

The dispersant used in the dispersion method under consideration is preferably removed from the obtained dispersion to the maximum extent possible, and this is more preferably carried out at the same time as the classification process.

An additional heating step may be provided in this production method after removal of the organic solvent. The implementation of the heating step makes it possible to smooth out the toner particle surface and to adjust the extent of spheronizing of the toner particle surface.

The fine particle fraction in the liquid can be removed in the classification process using, for example, a cyclone, decanter, centrifugal separation, and so forth. The classification process may of course be carried out after the particles have been recovered after drying, but it is preferably run in the liquid from an efficiency standpoint.

The unwanted fine or coarse particles obtained in this classification process may be returned to the dissolution step and re-used for particle formation. At this time the fine or coarse particles may be in a wet condition.

Inorganic microparticles can be used in the toner of the present invention as an external additive in order to assist or support the toner's fluidity, developing performance, and charging properties.

The primary particle diameter of these inorganic microparticles is preferably at least 5 nm and no more than 2 μm and more preferably is at least 5 nm and no more than 500 nm. In addition, the BET specific surface area of the inorganic microparticles is preferably at least 20 $m^2/g$ and no more than 500 $m^2/g$.

The inorganic microparticles are used at the rate preferably of at least 0.01 mass part and no more than 5 mass parts per 100 mass parts toner particles and more preferably at least 0.01 mass part and no more than 2.0 mass parts per 100 mass parts toner particles.

A single type of inorganic microparticle may be used, or a plurality of types may be used in combination.

The inorganic microparticle can be specifically exemplified by the following: silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

In order to avoid impairing the flow and charging characteristics of the toner at high humidities, the hydrophobicity of the inorganic microparticle is preferably raised using a surface treatment agent.

The following are examples of preferred surface treatment agents: silane coupling agents, silylating agents, fluoroalkyl-functional silane coupling agents, organotitanate-type coupling agents, aluminum-based coupling agents, silicone oils, modified silicone oils, and so forth.

The following are examples of external agents (cleaning improvers) added for the purpose of removing the toner that remains post-transfer on the photosensitive member and/or the primary transfer medium: the metal salts of aliphatic acids, e.g., zinc stearate, calcium stearate, stearic acid, and so forth, and polymer microparticles produced by, for example, soap-free emulsion polymerization, e.g., polymethyl methacrylate microparticles, polystyrene microparticles, and so forth.

These polymer microparticles preferably have a relatively narrow particle size distribution and a volume-average particle diameter of from 0.01 to 1 μm.

The methods of measuring the various properties of the toner of the present invention are described below.

<Method of Measuring the Acid Value of a Resin>

The acid value refers to the number of milligrams of potassium hydroxide required to neutralize the acid present in 1 g of sample. The acid value of a resin is measured based on JIS K 0070-1966 and in specific terms is measured according to the following procedure.

(1) Reagent Preparation

A "phenolphthalein solution" is obtained by dissolving 1.0 g phenolphthalein in 90 mL ethyl alcohol (95 volume %) and bringing the volume to 100 mL by the addition of ion-exchanged water.

A "potassium hydroxide solution" is obtained by dissolving 7 g special-grade potassium hydroxide in 5 mL water; bringing the volume to 1 liter by the addition of ethyl alcohol (95 volume %); introduction into a base-resistant container so as to prevent contact with carbon dioxide; standing for 3 days; and then filtration. The resulting potassium hydroxide solution is stored in a base-resistant container. Standardization is performed in accordance with JIS K 0070-1966.

(2) Procedure (A) The Sample Test

A 2.0 g sample of the ground resin is precisely weighed into a 200-mL Erlenmeyer flask and 100 mL of a toluene/ethanol (2:1) mixed solution is added and dissolution is carried out over 5 hours. Several drops of the previously described phenolphthalein solution are then added as the indicator and titration is performed using the previously described potassium hydroxide solution. The persistence of the pale pink color of the indicator for about 30 seconds is taken to be the titration endpoint.

(B) The Blank Test

Titration is carried out as in the procedure described above, but in this case in the absence of the sample (i.e., with only the toluene/ethanol (2:1) mixed solution)

(3) Calculation of the Acid Value

The obtained results are substituted into the following formula to calculate the acid value $$A=[(B-C)\times f\times 5.61]/S$$

wherein A: acid value (mg KOH/g), B: addition (mL) of potassium hydroxide solution in the blank test, C addition (mL) of potassium hydroxide solution in the sample test, f: factor for the potassium hydroxide solution, and S: sample (g).

<Method of Measuring the Hydroxyl Value of a Resin>

The hydroxyl value is the number of milligrams of potassium hydroxide required to neutralize the acetic acid bonded to the hydroxyl group when 1 g of sample has been acetylated. The hydroxyl value of a resin is measured based on JIS K 0070-1966 and in specific terms is measured according to the following procedure.

(1) Reagent Preparation

The "acetylation reagent" is obtained by introducing 25 g special-grade acetic anhydride into a 100-mL volumetric flask; bringing the total volume to 100 mL by adding pyridine; and thoroughly shaking. The resulting acetylation reagent is stored in a brown bottle so as to prevent contact with humidity, carbon dioxide, and so forth.

A "phenolphthalein solution" is obtained by dissolving 1.0 g phenolphthalein in 90 mL ethyl alcohol (95 volume %) and bringing the volume to 100 mL by the addition of ion-exchanged water.

35 g special-grade potassium hydroxide is dissolved in 20 mL water and the volume is brought to 1 liter by the addition of ethyl alcohol (95 volume %). After introduction into a base-resistant container so as to prevent contact with carbon dioxide and so forth and standing for 3 days, filtration then yields a "potassium hydroxide solution". The resulting potassium hydroxide solution is stored in a base-resistant container. Standardization is performed in accordance with JIS K 8005-1951.

(2) Procedure (A) The Sample Test

A 1.0 g sample of the ground resin is precisely weighed into a 200-mL roundbottom flask and 5.0 mL of the previously described acetylation reagent is accurately added using a volumetric pipette. When the sample is difficult to dissolve in the acetylation reagent at this point, dissolution is carried out with the addition of a small amount of special-grade toluene.

A small funnel is placed in the mouth of the flask and heating is carried out by immersing the bottom of the flask about 1 cm into a glycerol bath at approximately 97° C. When this is done, the temperature of the neck of the flask will rise due to heat from the bath, and in order to prevent this a thick piece of paper with a round hole made therein is preferably mounted at the base of the neck of the flask.

After 1 hour, the flask is removed from the glycerol bath and cooled. After cooling, 1 mL water is added through the funnel and the acetic anhydride is hydrolyzed with shaking. The flask is reheated for 10 minutes on the glycerol bath in order to achieve complete hydrolysis. After cooling, the funnel and flask wall are washed with 5 mL ethyl alcohol.

Several drops of the previously described phenolphthalein solution are added as indicator and titration is performed using the previously described potassium hydroxide solution. The persistence of the pale pink color of the indicator for about 30 seconds is taken to be the titration endpoint.

(B) The Blank Test

Titration is performed as in the procedure described above, but in this case in the absence of the binder resin sample.

(3) Calculation of the Hydroxyl Value

The obtained results are substituted into the following formula to calculate the hydroxyl value $$A=[\{(B-C)\times 28.05\times f\}/S]+D$$

wherein A: hydroxyl value (mg KOH/g), B: addition (mL) of potassium hydroxide solution in the blank test, C: addition (mL) of potassium hydroxide solution in the sample test, f: factor for the potassium hydroxide solution, S: sample (g), and D: acid value (mg KOH/g) of the resin.

<Method of Measuring the Surface Acid Value of the Toner Particles>

The surface acid value (mg KOH/g) of the toner particles is measured by modifying the previously described method of determining the acid value of the resin as follows: the solvent used is changed to special-grade ethanol and the measurement is carried out without dissolution of the toner particles. The modified procedure is described below.

(1) Procedure (A) The Sample Test

A 2.0 g sample of the ground binder resin is precisely weighed into a 200-mL Erlenmeyer flask and 100 mL special-grade ethanol solution is added and the sample is dispersed in the solution. Several drops of the previously described phenolphthalein solution are then added as indicator and titration is performed using the previously described potassium hydroxide solution. The persistence of the pale pink color of the indicator for about 30 seconds is taken to be the titration endpoint.

(B) The Blank Test

Titration is performed as in the procedure described above, but in this case in the absence of the sample (i.e., with only the special-grade ethanol solution).

(2) Calculation of the Surface Acid Value.

The obtained results are substituted into the following formula to calculate the acid value $$A=[(B-C)\times f\times 5.61]/S$$

wherein A: acid value (mg KOH/g), B: addition (mL) of potassium hydroxide solution in the blank test, C: addition (mL) of potassium hydroxide solution in the sample test, f: factor for the potassium hydroxide solution, and S: sample (g).

<Method of Measuring the Hydroxyl Value Per Specific Surface Area of the Toner Particles>

The hydroxyl value per specific surface area of the toner particles (mg KOH/$m^2$) is determined by determining the surface hydroxyl value (mg KOH/g) of the toner particles and the specific surface area ($m^2$/g) of the toner and dividing the surface hydroxyl value of the toner particles by the specific surface area of the toner. The surface hydroxyl value (mg KOH/g) of the toner particles is measured by modifying the procedure in the previously described method of determining the hydroxyl value of the resin in order to carry out the measurement under conditions in which the toner particles are not dissolved. The modified procedure is given below.

(1) Reagent Preparation

The "acetylation reagent" is obtained by introducing 25 g special-grade acetic anhydride into a 100-mL volumetric flask; bringing the total volume to 100 mL by adding ethyl alcohol; and thoroughly shaking. The resulting acetylation reagent is stored in a brown bottle so as to prevent contact with humidity, carbon dioxide, and so forth.

A "phenolphthalein solution" is obtained by dissolving 1.0 g phenolphthalein in 90 mL ethyl alcohol (95 volume %) and bringing the volume to 100 mL by the addition of ion-exchanged water.

35 g special-grade potassium hydroxide is dissolved in 20 mL water and the volume is brought to 1 liter by the addition of ethyl alcohol (95 volume %). After introduction into a base-resistant container so as to prevent contact with carbon dioxide and so forth and standing for 3 days, filtration then yields a "potassium hydroxide solution". The resulting potassium hydroxide solution is stored in a base-resistant container. Standardization is performed in accordance with JIS K 8005-1951.

(2) Procedure (A) The Sample Test

A 1.0 g sample of the toner particles is precisely weighed into a 200-mL roundbottom flask and 5.0 mL of the previously described acetylation reagent is accurately added using a volumetric pipette. When the sample is difficult to disperse in the acetylation reagent at this point, uniform dispersion is brought about using an ultrasonic disperser.

A small funnel is placed in the mouth of the flask and heating is carried out by immersing the bottom of the flask about 1 cm into a glycerol bath at approximately 97° C. When this is done, the temperature of the neck of the flask will rise due to heat from the glycerol bath, and in order to prevent this a thick piece of paper with a round hole made therein is preferably mounted at the base of the neck of the flask.

After 1 hour, the flask is removed from the glycerol bath and cooled. After cooling, 1 mL water is added through the funnel and the acetic anhydride is hydrolyzed with shaking. The flask is reheated for 10 minutes on the glycerol bath in order to achieve complete hydrolysis. After cooling, the funnel and flask wall are washed with 5 mL ethyl alcohol.

Several drops of the previously described phenolphthalein solution are added as indicator and titration is performed using the previously described potassium hydroxide solution. The persistence of the pale pink color of the indicator for about 30 seconds is taken to be the titration endpoint.

(B) The Blank Test

Titration is performed as in the procedure described above, but in this case in the absence of the binder resin sample.

(3) Calculation of the Surface Hydroxyl Value

The obtained results are substituted into the following formula to calculate the hydroxyl value $$A=[\{(B-C)\times 28.05\times f\}/S]+D$$

wherein A: hydroxyl value (mg KOH/g), B: addition (mL) of potassium hydroxide solution in the blank test, C: addition (mL) of potassium hydroxide solution in the sample test, f: factor for the potassium hydroxide solution, S: sample (g), and D: surface acid value (mg KOH/g) of the resin.

(4) Measurement of the Specific Surface Area

Figure 3:
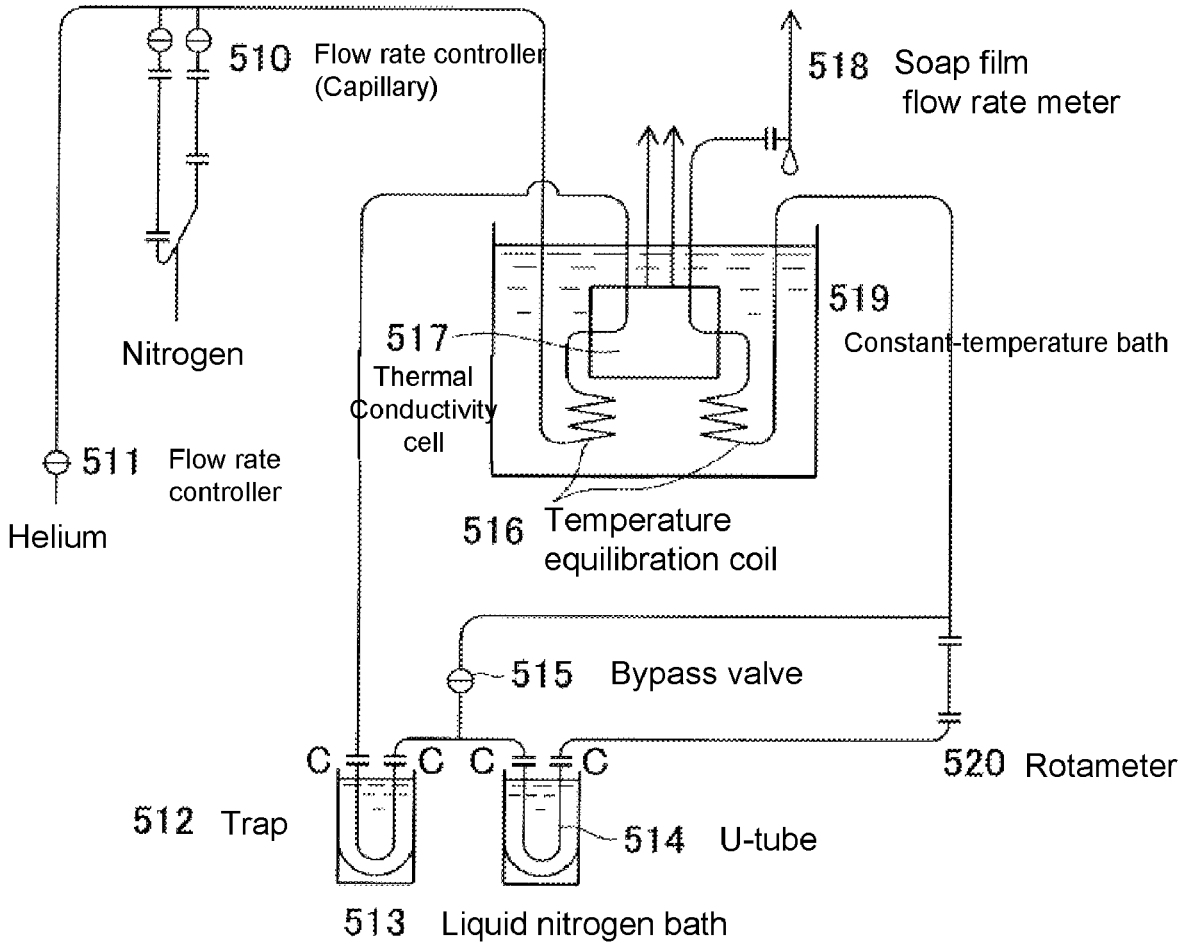
FIG. 3 is a schematic drawing of a measurement instrument that determines the specific surface area of a toner.

The specific surface area of the toner is then measured. The specific surface area of the toner is measured based on the BET method in ASTM D 3037-78. The toner is exposed, in accordance with the flow configuration shown in FIG. 3, to the flow of a mixed gas of $N_2$ and He in order to carry out $N_2$ adsorption, the amount of which is detected by a thermal conductivity cell. The specific surface area of the sample is determined by calculation from the amount of $N_2$ adsorption.

(1) The sample is dried for 1 hour at 105° C.; 0.1 to 1 g is then precisely weighed out and placed in the U-tube 514; and this is mounted in the flow path.

(2) A prescribed $P/P_0$ is established by varying the $N_2$/He mixing ratio using the flow rate controllers 510 and 511.

(3) The cock is opened and adsorption gas is introduced to the sample layer, after which the U-tube is immersed in the liquid nitrogen bath 513 and $N_2$ adsorption is carried out.

(4) After adsorption equilibrium has been achieved, the liquid $N_2$ is removed; exposure to air for approximately 30 seconds is carried out; and the U-tube is then immersed in water at room temperature in order to carry out $N_2$ desorption.

(5) The desorption curve is traced on a recorder and its area is measured.

(6) Using a calibration curve constructed by preliminarily introducing a known quantity of $N_2$ in the preceding procedure, the quantity of $N_2$ adsorption is determined at the prescribed $P/P_0$ from the area obtained for the sample.

The specific surface area is then determined using the following formula.

$$P/\nu(P_0-P)=1/\nu m/C+(C-1)/\nu m/C\cdot P/P_0 \quad \text{(formula)}$$

$P_0$: saturated vapor pressure of the adsorbate at the measurement temperature

P: pressure at the adsorption equilibrium

ν: quantity of adsorption at the adsorption equilibrium

C: constant

The relationship between $P/P_0$ and $P/\nu(P_0-P)$ forms a straight line, and νm is determined from its slope and intercept. Once vm has been determined, the specific surface area S is calculated from the following formula.

$$S=A\times vm\times N/W \quad \text{(formula)}$$

S: specific surface area

A: cross-sectional area of the adsorbed molecule

N: Avogadro's number

W: quantity of sample

<Method of Measuring the Glass Transition Temperature (Tg) of the Toner and Resins>

Measurement of the Tg of the toner and resins was performed in the present invention under the following conditions using a DSC Q1000 (TA Instruments) differential thermal calorimeter (DSC).

Measurement Conditions modulation mode rate of temperature rise: 0.5° C./min or 4.0° C./min modulation temperature amplitude: ±1.0° C./min temperature at start of measurement: 25° C.

temperature at end of measurement: 130° C.

A fresh measurement sample was prepared when the rate of temperature rise was changed. The temperature rise was carried out only once; the DSC curve was obtained by plotting the "Reversing Heat Flow" on the vertical axis; and the Tg cited by the present invention was taken to be the onset value shown in FIG. 1.

The glass transition temperature Tg(0.5) at a rate of temperature rise of 0.5° C./min and the glass transition temperature Tg(4.0) at a rate of temperature rise of 4.0° C./min were both measured and Tg(4.0)-Tg(0.5) was calculated as the difference between the two.

In the absence of a specific indication (for example, the polyester resins in the examples), a rate of temperature rise of 0.5° C./min was used in the conditions listed above.

<Method of Measuring the Nitrogen Content (N) at the Toner Particle Surface>

The nitrogen content (N) at the toner particle surface in the present invention was calculated using surface composition analysis by x-ray photoelectron spectroscopy (ESCA). The ESCA instrumentation and measurement conditions are provided below instrumentation: Quantum 2000 Scanning ESCA Microprobe (Physical Electronics Industries, Inc. (PHI)) analytic method: narrow analysis Measurement Conditions:

| | |
|---|---|
| x-ray source: | N (50μ, 12.5 W, 15 kV) |
| photoelectron angle: | 45° |
| pass energy: | 46.95 eV |
| measurement range: | ϕ 50 μm |
| measurement time: | 15 to 30 minutes |

<Method of Measuring the Maximum Value of the Loss Elastic Modulus G" and Method of Measuring the Storage Elastic Modulus G' at 130° C. of the Toner ($G'_{130}$)>

The measurements are carried out using an ARES viscoelastic measurement instrument (rheometer) from Rheometrics Scientific Inc. A summary of the measurement is described in ARES Operating Manuals 902-30004 (August, 1997 edition) and 902-00153 (July, 1993 edition) published by Rheometrics Scientific Inc., and is also provided below.

Measurement tool: serrated parallel plates, diameter 7.9 mm

Measurement sample: A cylindrical sample (diameter approximately 8 mm, height approximately 2 mm) of the toner particles is fabricated using a press molder (15 kN maintained for 1 minute at ambient temperature). An NT-100H 100 kN press from NPa System. Co., Ltd., is used as the press molder.

While controlling the temperature of the serrated parallel plates to 80° C., the cylindrical sample is heated and melted and the serration is engaged and a perpendicular load is applied such that the axial force does not exceed 30 (g of weight), thereby fixing the sample to the serrated parallel plates. When this is done, a steel belt may be used in order to make the diameter of the sample the same as the diameter of the parallel plates. The serrated parallel plates and cylindrical sample are gradually cooled over 1 hour to the measurement start temperature of 30.00° C.

Measurement frequency: 6.28 radian/s

Measurement strain setting: the starting value is set to 0.1% and measurement is carried out in automatic measurement mode Sample expansion correction: adjusted by the automatic measurement mode Measurement temperature: The temperature is raised at 2° C./minute from 30° C. to 150° C.

Measurement interval: The viscoelastic data is measured every 30 seconds, i.e., every 1° C.

The data is transmitted through the interface to RSI Orchestrator (control, data collection, and data analysis software from Rheometrics Scientific) operating under Windows 2000 (Microsoft).

The temperature giving the maximum value of the loss elastic modulus G" and the storage elastic modulus G' at 130° C. ($G'_{130}$) of the toner are read out with this data.

<Method of Measuring the Weight-Average Particle Diameter (D4) and the Number-Average Particle Diameter (D1) of the Toner>

The weight-average particle diameter (D4) and the number-average particle diameter (D1) of the toner were obtained using the "Coulter Counter Multisizer 3" (registered trademark, from Beckman Coulter, Inc), a precision particle size distribution measurement instrument operating on the pore electrical resistance principle and equipped with a 100 μm aperture tube, and also using the accompanying dedicated software (Beckman Coulter Multisizer 3 Version 3.51) in order to set the measurement conditions and analyze the measurement data. The measurements were carried at 25,000 channels for the number of effective measurement channels and the measurement data was analyzed and the weight-average particle diameter (D4) and number-average particle diameter (D1) were calculated.

The aqueous electrolyte solution used for the measurements is prepared by dissolving special-grade sodium chloride in ion-exchanged water to provide a concentration of about 1 mass % and, for example, "ISOTON II" (from Beckman Coulter, Inc.) can be used.

The dedicated software was configured as follows prior to measurement and analysis.

In the "screen for modifying the standard operating method (SOM)" in the dedicated software, the total count number in the control mode was set to 50,000 particles; the number of measurements was set to 1 time; and the Kd value was set to the value obtained using "standard particle 10.0 μm" (from Beckman Coulter, Inc.). The threshold value and noise level were automatically set by pressing the threshold value/noise level measurement button. In addition, the current was set to 1600 μA; the gain was set to 2; the electrolyte was set to ISOTON II; and a check was entered for the post-measurement aperture tube flush.

In the "screen for setting conversion from pulses to particle diameter" of the dedicated software, the bin interval was set to logarithmic particle diameter; the particle diameter bin was set to 256 particle diameter bins; and the particle diameter range was set to 2 μm to 60 μm.

The specific measurement procedure is as follows.

(1) Approximately 200 mL of the previously described aqueous electrolyte solution was introduced into a 250-mL roundbottom glass beaker intended for use with the Multisizer 3 and this was placed in the sample stand and counterclockwise stirring with the stirrer rod was carried out at 24 rotations per second. Contamination and air bubbles within the aperture tube have previously been removed by the "aperture flush" function of the analytic software.

(2) Approximately 30 mL of the previously described aqueous electrolyte solution was introduced into a 100-mL flatbottom glass beaker, and to this was added about 0.3 mL of a dilution prepared by the three-fold (mass) dilution with ion-exchanged water of the dispersant "Contaminon N" (a 10 mass % aqueous solution (pH 7) of a neutral detergent for cleaning precision measurement instrumentation, comprising a nonionic surfactant, anionic surfactant, and organic builder, from Wako Pure Chemical Industries, Ltd.).

(3) A prescribed quantity of ion-exchanged water was introduced into the water tank of an "Ultrasonic Dispersion System Tetora 150" (ultrasound disperser from Nikkaki Bios Co., Ltd., electrical output=120 W, equipped with two oscillators (oscillation frequency=50 kHz) disposed such that the phases are displaced by 180°), and approximately 2 mL of Contaminon N was added to the water tank.

(4) The beaker described in (2) was set into the beaker holder opening on the ultrasound disperser and the ultrasound disperser was started. The height of the beaker was adjusted in such a manner that the resonance condition of the surface of the aqueous electrolyte solution within the beaker was at a maximum.

(5) While the aqueous electrolyte solution within the beaker set up according to (4) was being irradiated with ultrasound, approximately 10 mg toner was added to the aqueous electrolyte solution in small aliquots and dispersion was carried out. The ultrasound dispersion treatment was continued for an additional 60 seconds. The water temperature in the water bath was controlled as appropriate during ultrasound dispersion to be at least 10° C. and no more than 40° C.

(6) Using a pipette, the dispersed toner-containing aqueous electrolyte solution prepared in (5) was dripped into the roundbottom beaker set in the sample stand as described in (1) with adjustment to provide a measurement concentration of about 5%. Measurement was then performed until the number of measured particles reached 50,000.

(7) The measurement data was analyzed by the previously cited software provided with the instrument and the weight-average particle diameter (D4) and the number-average particle diameter (D1) were calculated. When set to graph/volume % with the software, the "average diameter" on the analysis/volumetric statistical value (arithmetic average) screen is the weight-average particle diameter (D4), and when set to graph/number % with the software, the "average diameter" on the analysis/numerical statistical value (arithmetic average) screen is the number-average particle diameter (D1.).

<Method of Measuring the Average Circularity of the Toner and Method of Measuring the Fines Fraction of the Toner>

The average circularity of the toner was measured using the FPIA-3000, a flow-type particle image analyzer from the Sysmex Corporation. The measurements were carried out using the measurement and analysis conditions from the calibration process.

The specific measurement method was as follows. A suitable quantity of a surfactant (preferably sodium dodecylbenzenesulfonate) was added as a dispersant to 20 mL ion-exchanged water; 0.02 g of the measurement sample was added; and a dispersion treatment was carried out for 2 minutes using a benchtop ultrasound cleaner/disperser that had an oscillation frequency of 50 kHz and an electrical output of 150 W (for example, a VS-150 from Velvo-Clear Co., Ltd.), thereby providing a dispersion for submission to measurement. Cooling was carried out as appropriate during this treatment so as to provide a dispersion temperature of at least 10° C. and no more than 40° C.

The previously cited flow-type particle image analyzer (fitted with a standard objective lens (10×)) was used for the measurement, and Particle Sheath PSE-900A (Sysmex Corporation) was used for the sheath solution. The dispersion prepared according to the previously described procedure was introduced into the flow-type particle image analyzer; 3,000 toner particles were measured according to total count mode in HPF measurement mode; and the average circularity of the toner particles was determined with the binarization threshold value during particle analysis set at 85% and the analyzed particle diameter limited to a circle-equivalent diameter of at least 2.00 μm and no more than 200.00 μm.

For this measurement, automatic focal point adjustment is performed prior to the start of the measurement using reference latex particles (for example, a dilution of 5100A from Duke Scientific with ion-exchange water). After this, focal point adjustment is preferably performed every two hours after the start of measurement.

The examples in this application employed a flow-type particle image analyzer that had been calibrated by the Sysmex Corporation and that had been issued a calibration certificate by the Sysmex Corporation, and the measurements were carried out under the same measurement and analysis conditions as when the calibration certificate was received, with the exception that the analyzed particle diameter was limited to a circle-equivalent diameter of at least 2.00 nm and no more than 200.00 μm.

On the other hand, for the fines fraction in the toner, measurement was performed, in the same manner as the measurement of the average circularity, in the range of at least 0.60 μm to no more than 200.00 μm for the analyzed particle diameter; the numerical frequency for greater than or equal to 0.60 μm to less than or equal to 2.00 μm was determined; and its percentage with respect to the total range from at least 0.60 μm to no more than 200.00 μm was determined. This was designated as the toner fines fraction.

<Method of Measuring the Molecular Weight Distribution, Peak Molecular Weight, and Number-Average Molecular Weight of the Resins by Gel Permeation Chromatography (GPC)>

The molecular weight distribution, peak molecular weight, and number-average molecular weight of the resins were measured by gel permeation chromatography (GPC) by measuring the tetrahydrofuran (THF)-soluble matter of the resins by GPC (gel permeation chromatography) using THF as the solvent. The measurement conditions are as follows.

(1) Measurement Sample Preparation

The resin (sample) and THF were mixed at a concentration of approximately 0.5 to 5 mg/mL (for example, approximately 5 mg/mL). After standing for several hours (for example, 5 to 6 hours) at room temperature, the THF and sample were thoroughly mixed by vigorous shaking until there was no unified sample mass. This was followed by additional holding at quiescence at room temperature for at least 12 hours (for example, for 24 hours). At this point, the procedure had been performed in such a manner that the time from the start of mixing between the sample and THF to the completion of holding at quiescence was at least 24 hours.

The GPC sample was then obtained by passage through a sample treatment filter (pore size=0.45 to 0.5 μm, a Maishori Disk H-25-2 (Tosoh) or an Ekicrodisc 25CR (Gelman Sciences Japan) is preferably used).

(2) Sample Measurement

The column was stabilized in a heated chamber at 40° C. and THF (solvent) was introduced at a flow rate of 1 mL/minute to the column at this temperature. Measurement was carried out by injecting 50 to 200 μL of the THF sample solution of the resin wherein the sample concentration had been adjusted to 0.5 to 5 mg/mL.

In this measurement of sample molecular weight, the molecular weight distribution exhibited by the sample was calculated from the relationship between the logarithmic value and number of counts on a calibration curve constructed using a plurality of monodisperse polystyrene standards. The following were used as the polystyrene standards for construction of the calibration curve: molecular weight=$6\times10^2$, $2.1\times10^3$, $4\times10^3$, $1.75\times10^4$5.$1\times10^4$, $1.1\times10^5$, $3.9\times10^5$, $8.6\times10^5$, $2\times10^6$ and $4.48\times10^6$, from Pressure Chemical Co., or Toyo Soda Manufacturing Co., Ltd. A refractive index (RI) detector was used as the detector.

In order to provide accurate measurement in the molecular weight range of $1\times10^3$ to $2\times10^6$, a plurality of commercially available polystyrene gel columns were combined as shown below and this combination was used as the column. The GPC measurement conditions used in the present invention are as follows.

GPC Measurement Conditions

| | |
|---|---|
| instrument: | LP-GPC 150 C (Waters Corporation) |
| column: | a train of 7: KF 801, 802, 803, 804, 805, 806, 807 (from Shodex) |
| column temperature: | 40° C. |
| mobile phase: | tetrahydrofuran (THF) |

<Method of Measuring the Particle Diameter of the Dispersed Particles in a Dispersion>

The particle diameter of the dispersed particles in a dispersion was measured using an HRA (X-100) Microtrac (from Nikkiso Co., Ltd.) particle size distribution analyzer with the range set to 0.001 μm to 10 μm; the measurement was carried out to give the number-average particle diameter (μm or nm). Water was selected for the dilution solvent.

<Method of Measuring the Wax Melting Point>

The wax melting point was measured based on ASTM D 3418-82 using a Q1000 (TA Instruments) differential scanning calorimeter (DSC).

The melting points of indium and zinc were used for temperature correction in the instrument's detection section, and the heat of fusion of indium was used to correct the amount of heat.

Specifically, approximately 10 mg of the sample was accurately weighed out and placed in an aluminum pan and the measurement was carried out at a rate of temperature rise of 10° C./min in the measurement temperature range of 30 to 200° C. using an empty aluminum pan for reference. The measurement was performed by raising the temperature to 200° C., then lowering the temperature to 30° C., and thereafter raising the temperature once again. The temperature in this second temperature ramp-up step at which the highest endothermic peak appeared in the DSC curve in the 30° C. to 200° C. temperature range was taken to be the melting point of the wax. In those instances in which a plurality of peaks were present, this highest endothermic peak was taken to be the peak with the greatest amount of heat absorption.

EXAMPLES

Hereinafter, the present invention is described in greater detail by examples, but the present invention is in no way limited by these examples. Unless specified otherwise, the number of parts in the compositions provided below refers to mass parts.

<Preparation of Resin Microparticle Dispersion 1>

The following were introduced under a nitrogen current into a reactor equipped with a stirrer and thermometer.

| | |
|---|---|
| ethylene oxide adduct (2 mol) on bisphenol A (hydroxyl value = 272 mg KOH/g) | 96 mass parts |
| 2,2-dimethylolpropanoic acid | 42 mass parts |
| sodium 3-(2,3-dihydroxypropoxy)-1-propanesulfonate | 5 mass parts |
| isophorone diisocyanate | 92 mass parts |
| hexamethylene diisocyanate | 15 mass parts |
| triethylamine (urethane formation reaction catalyst) | 3 mass parts |
| acetone | 250 mass parts |

The urethane formation reaction was carried out over 15 hours with heating at 50° C. to produce a solution of hydroxyl-terminated urethane resin. The isocyanate group content at the completion of the urethane formation reaction was 0%. In order to neutralize the carboxyl group in the 2,2-dimethylolpropanoic acid, after cooling to 40° C., 29 mass parts triethylamine (the equivalent amount) was added with mixing, thus yielding a reaction mixture. A portion of the reaction mixture was dried to obtain urethane resin (b)-1. The THF-soluble matter in urethane resin (b)-1 was 90 mass % and its Mn was 1900 and its Mw/Mn was 6.5. The properties of urethane resin (b)-1 (also referred to below simply as b-1) are shown in Table 1.

While stirring with a homomixer, the reaction mixture was poured into 1000 mass parts water and was emulsified. This was followed by transfer to a beaker and standing for 1 day in a draft while spinning the emulsion with a stirring blade, to obtain the resin microparticle dispersion 1 in the form of a polyurethane resin emulsion. The number-average particle diameter of the dispersed particles in resin microparticle dispersion 1 was 62 nm. The solids matter proportion in resin microparticle dispersion 1 was adjusted to 20 mass %. The properties of resin microparticle dispersion 1 are shown in Table 1.

<Preparation of Resin Microparticle Dispersion 2>

The following were introduced under a nitrogen current into a reactor equipped with a stirrer and thermometer.

| | |
|---|---|
| polyester diol produced from 1,4-butanediol and adipic acid (hydroxyl value = 114 mg KOH/g) | 116 mass parts |
| 2,2-dimethylolpropanoic acid | 42 mass parts |
| sodium 3-(2,3-dihydroxypropoxy)-1-propanesulfonate | 8 mass parts |
| isophorone diisocyanate | 84 mass parts |
| triethylamine (urethane formation reaction catalyst) | 3 mass parts |
| acetone | 250 mass parts |

The urethane formation reaction was carried out over 15 hours with heating at 50° C. to produce a solution of hydroxyl-terminated urethane resin. The isocyanate group content at the completion of the urethane formation reaction was 0%. In order to neutralize the carboxyl group in the 2,2-dimethylolpropanoic acid, after cooling to 40° C., 29 mass parts triethylamine (the equivalent amount) was added with mixing, thus yielding a reaction mixture. A portion of the reaction mixture was dried to obtain urethane resin (b)-2 (also referred to below simply as b-2). The THE-soluble matter in urethane resin (b)-2 was 70 mass % and its Mn was 5300 and its Mw/Mn was 13.4. The properties of urethane resin (b)-2 are shown in Table 1.

While stirring with a homomixer, the reaction mixture was poured into 1000 mass parts water and was emulsified. This was followed by transfer to a beaker and standing for 1 day in a draft while spinning the emulsion with a stirring blade, to obtain the resin microparticle dispersion 2 in the form of a polyurethane resin emulsion. The number-average particle diameter of the dispersed particles in resin microparticle dispersion 2 was 55 nm. The solids matter proportion in resin microparticle dispersion 2 was adjusted to 20 mass %. The properties of resin microparticle dispersion 2 are shown in Table 1.

<Preparation of Resin Microparticle Dispersion 3>

The following were introduced under a nitrogen current into a reactor equipped with a stirrer and thermometer.

| | |
|---|---|
| polyester diol produced from 1,4-butanediol and adipic acid (hydroxyl value = 114 mg KOH/g) | 76 mass parts |
| cyclohexanedimethanol | 14 mass parts |
| 2,2-dimethylolpropanoic acid | 35 mass parts |
| sodium 3-(2,3-dihydroxypropoxy)-1-propanesulfonate | 4 mass parts |
| isophorone diisocyanate | 107 mass parts |
| hexamethylene diisocyanate | 14 mass parts |
| triethylamine (urethane formation reaction catalyst) | 3 mass parts |
| acetone | 250 mass parts |

The urethane formation reaction was carried out over 15 hours with heating at 50° C. to produce a solution of hydroxyl-terminated urethane resin. The isocyanate group content at the completion of the urethane formation reaction was 0%. In order to neutralize the carboxyl group in the 2,2-dimethylolpropanoic acid, after cooling to 40° C., 26 mass parts triethylamine (the equivalent amount) was added with mixing, thus yielding a reaction mixture. A portion of the reaction mixture was dried to obtain urethane resin (b)-3 (also referred to below simply as b-3). The THF-soluble matter in urethane resin (b)-3 was 83 mass % and its Mn was 800 and its Mw/Mn was 14.5. The properties of urethane resin (b)-3 are shown in Table 1.

While stirring with a homomixer, the reaction mixture was poured into 1000 mass parts water and was emulsified. This was followed by transfer to a beaker and standing for 1 day in a draft while spinning the emulsion with a stirring blade, to obtain the resin microparticle dispersion 3 in the form of a polyurethane resin emulsion. The number-average particle diameter of the dispersed particles in resin microparticle dispersion 3 was 45 nm. The solids matter proportion in resin microparticle dispersion 3 was adjusted to 20 mass %. The properties of resin microparticle dispersion 3 are shown in Table 1.

<Preparation of Resin Microparticle Dispersion 4>

A composition was obtained by introducing the following into a reactor equipped with a condenser, nitrogen introduction tube, and stirrer.

| | |
|---|---|
| styrene | 330 mass parts |
| n-butyl acrylate | 110 mass parts |
| acrylic acid | 10 mass parts |
| 2-butanone (solvent) | 50 mass parts |

8 mass parts of the polymerization initiator 2,2'-azobis(2,4-dimethylvaleronitrile) was dissolved in the composition to obtain a polymerizable monomer composition. This polymerizable monomer composition was polymerized for 8 hours at 60° C., after which the temperature was raised to 150° C. and the solvent was removed under reduced pressure and the product was then removed from the reactor. After the product had been cooled to room temperature, it was particulated by grinding to obtain a linear vinyl resin. 100 mass parts of this resin was mixed with 400 mass parts toluene and the mixture was heated to 80° C. to dissolve the resin and give a resin solution.

360 mass parts ion-exchanged water and 40 mass parts of a 48.5% aqueous solution of sodium dodecyldiphenyl ether disulfonate (Eleminol MON-7 from Sanyo Chemical Industries, Ltd.) were mixed and the aforementioned resin solution was added with mixing and stirring to obtain a milky white liquid. The toluene was removed under reduced pressure and ion-exchanged water was added to give resin microparticle dispersion 4 having a solids matter of 20 mass %. The properties of resin (b-4), which was obtained by drying resin microparticle dispersion 4 to solidification, are shown in Table 1.

<Preparation of Resin Microparticle Dispersion 5>

The following were introduced under a nitrogen current into a reactor equipped with a stirrer and thermometer.

| | |
|---|---|
| polyester diol produced from 1,4-butanediol and adipic acid (hydroxyl value = 114 mg KOH/g) | 82 mass parts |
| neopentyl glycol | 19 mass parts |
| 2,2-dimethylolpropanoic acid | 37 mass parts |
| sodium 3-(2,3-dihydroxypropoxy)-1-propanesulfonate | 6 mass parts |
| isophorone diisocyanate | 113 mass parts |
| triethylamine (urethane formation reaction catalyst) | 3 mass parts |
| acetone | 250 mass parts |

The urethane formation reaction was carried out over 15 hours with heating at 0° C. to produce a solution of hydroxyl-terminated urethane resin. The isocyanate group content at the completion of the urethane formation reaction was 0%. In order to neutralize the carboxyl group in the 2,2-dimethylolpropanoic acid, after cooling to 40° C., 23 mass parts triethylamine (the equivalent amount) was added with mixing, thus yielding a reaction mixture. A portion of the reaction mixture was dried to obtain urethane resin (b)-5 (also referred to below simply as b-5). The THF-soluble matter in urethane resin (b)-5 was 73 mass % and its Mn was 4800 and its Mw/Mn was 9.3. The properties of urethane resin (b)-5 are shown in Table 1.

While stirring with a homomixer, a charge control agent solution—prepared by dissolving 2 mass parts of a zinc complex of salicylic acid (Bontron E-84 from Orient Chemical Industries, Ltd.) as the charge control agent in 18 mass parts acetone—was added to the reaction mixture, which was then poured into 1000 mass parts water and emulsified. This was followed by transfer to a beaker and standing for 1 day in a draft while spinning the emulsion with a stirring blade, to obtain the resin microparticle dispersion 5 in the form of a polyurethane resin emulsion. The number-average particle diameter of the dispersed particles in resin microparticle dispersion 5 was 65 nm. The solids matter proportion in resin microparticle dispersion 5 was adjusted to 20 mass %. The properties of resin microparticle dispersion 5 are shown in Table 1.

<Preparation of Resin Microparticle Dispersion 6>

The following were introduced under a nitrogen current into a reactor equipped with a stirrer and thermometer.

| | |
|---|---|
| polyester diol produced from 1,4-butanediol and adipic acid (hydroxyl value = 114 mg KOH/g) | 76 mass parts |
| cyclohexanedimethanol | 14 mass parts |
| 2,2-dimethylolpropanoic acid | 35 mass parts |
| sodium 3-(2,3-dihydroxypropoxy)-1-propanesulfonate | 4 mass parts |
| isophorone diisocyanate | 120 mass parts |
| hexamethylene diisocyanate | 14 mass parts |
| triethylamine (urethane formation reaction catalyst) | 3 mass parts |
| acetone | 250 mass parts |

The urethane formation reaction was carried out over 15 hours with heating at 50° C. to produce a solution of hydroxyl-terminated urethane resin. The isocyanate group content at the completion of the urethane formation reaction was 0%. In order to neutralize the carboxyl group in the 2,2-dimethylolpropanoic acid, after cooling to 40° C., 25 mass parts triethylamine (the equivalent amount) was added with mixing, thus yielding a reaction mixture. A portion of the reaction mixture was dried to obtain urethane resin (b)-6 (also referred to below simply as b-6). The THF-soluble matter in urethane resin (b)-6 was 87 mass % and its Mn was 1100 and its Mw/Mn was 9.1. The properties of urethane resin (b)-6 are shown in Table 1.

While stirring with a homomixer, the reaction mixture was poured into 1000 mass parts water and was emulsified. This was followed by transfer to a beaker and standing for 1 day in a draft while spinning the emulsion with a stirring blade, to obtain the resin microparticle dispersion 6 in the form of a polyurethane resin emulsion. The number-average particle diameter of the dispersed particles in resin microparticle dispersion 6 was 42 nm. The solids matter proportion in resin microparticle dispersion 6 was adjusted to 20 mass %. The properties of resin microparticle dispersion 6 are shown in Table 1.

<Preparation of Resin Microparticle Dispersion 7>

The following were introduced under a nitrogen current into a reactor equipped with a stirrer and thermometer.

| | |
|---|---|
| ethylene oxide adduct (4 mol) on bisphenol A (hydroxyl value = 254 mg KOH/g) | 111 mass parts |
| 2,2-dimethylolpropanoic acid | 39 mass parts |
| sodium 3-(2,3-dihydroxypropoxy)-1-propanesulfonate | 4 mass parts |
| isophorone diisocyanate | 96 mass parts |
| triethylamine (urethane formation reaction catalyst) | 3 mass parts |
| acetone | 250 mass parts |

The urethane formation reaction was carried out over 15 hours with heating at 50° C. to produce a solution of hydroxyl-terminated urethane resin. The isocyanate group content at the completion of the urethane formation reaction was 09. In order to neutralize the carboxyl group in the 2,2-dimethylolpropanoic acid, after cooling to 40° C., 26 mass parts triethylamine (the equivalent amount) was added with mixing, thus yielding a reaction mixture. A portion of the reaction mixture was dried to obtain urethane resin (b)-7 (also referred to below simply as b-7). The THF-soluble matter in urethane resin (b)-7 was 98 mass % and its Mn was 1700 and its Mw/Mn was 7.3. The properties of urethane resin (b)-7 are shown in Table 1.

While stirring with a homomixer, a charge control agent solution—prepared by dissolving 2 mass parts of a zinc complex of salicylic acid (Bontron E-84 from Orient Chemical Industries, Ltd.) as the charge control agent in 18 mass parts acetone—was added to the reaction mixture, which was then poured into 1000 mass parts water and emulsified. This was followed by transfer to a beaker and standing for 1 day in a draft while spinning the emulsion with a stirring blade, to obtain the resin microparticle dispersion 7 in the form of a polyurethane resin emulsion. The number-average particle diameter of the dispersed particles in resin microparticle dispersion 7 was 73 nm. The solids matter proportion in resin microparticle dispersion 7 was adjusted to 20 mass %. The properties of resin microparticle dispersion 7 are shown in Table 1.

<Preparation of Resin Microparticle Dispersion 8>

The following were introduced under a nitrogen current into a reactor equipped with a stirrer and thermometer.

| | |
|---|---|
| polyester diol produced from 1,4-butanediol and adipic acid (hydroxyl value = 114 mg KOH/g) | 93 mass parts |
| cyclohexanedimethanol | 17 mass parts |
| 2,2-dimethylolpropanoic acid | 41 mass parts |
| sodium 3-(2,3-dihydroxypropoxy)-1-propanesulfonate | 4 mass parts |
| isophorone diisocyanate | 84 mass parts |
| hexamethylene diisocyanate | 11 mass parts |
| triethylamine (urethane formation reaction catalyst) | 3 mass parts |
| acetone | 250 mass parts |

The urethane formation reaction was carried out over 15 hours with heating at 50° C. to produce a solution of hydroxyl-terminated urethane resin. The isocyanate group content at the completion of the urethane formation reaction was 0%. In order to neutralize the carboxyl group in the 2,2-dimethylolpropanoic acid, after cooling to 40° C., 28 mass parts triethylamine (the equivalent amount) was added with mixing, thus yielding a reaction mixture. A portion of the reaction mixture was dried to obtain urethane resin (b)-8 (also referred to below simply as b-8). The THF-soluble matter in urethane resin (b)-8 was 87 mass % and its Mn was 2600 and its Mw/Mn was 9.7. The properties of urethane resin (b)-8 are shown in Table 1.

While stirring with a homomixer, the reaction mixture was poured into 1000 mass parts water and was emulsified. This was followed by transfer to a beaker and standing for 1 day in a draft while spinning the emulsion with a stirring blade, to obtain the resin microparticle dispersion 8 in the form of a polyurethane resin emulsion. The number-average particle diameter of the dispersed particles in resin microparticle dispersion 8 was 64 nm. The solids matter proportion in resin microparticle dispersion 8 was adjusted to 20 mass %. The properties of resin microparticle dispersion 8 are shown in Table 1.

TABLE 1

| | resin obtained by drying to solidification | Mn | Mw/Mn | [NCO]/[OH] | hydroxyl value (mgKOH/g) |
|---|---|---|---|---|---|
| resin microparticle dispersion-1 | b-1 | 1900 | 6.5 | 0.79 | 43 |
| resin microparticle dispersion-2 | b-2 | 5300 | 13.4 | 1.25 | 16 |
| resin microparticle dispersion-3 | b-3 | 800 | 14.5 | 0.48 | 213 |
| resin microparticle dispersion-4 | b-4 | 16000 | 4.8 | — | 0 |
| resin microparticle dispersion-5 | b-5 | 4800 | 9.3 | 0.92 | 23 |
| resin microparticle dispersion-6 | b-6 | 1100 | 9.1 | 0.54 | 186 |
| resin microparticle dispersion-7 | b-7 | 1700 | 7.3 | 0.74 | 82 |
| resin microparticle dispersion-8 | b-8 | 2600 | 9.7 | 0.83 | 31 |

<Preparation of Polyester-1>

The following were introduced into a reactor equipped with a condenser, nitrogen introduction tube, and stirrer.

| | |
|---|---|
| 1,4-butanediol | 928 mass parts |
| dimethyl terephthalate | 776 mass parts |
| 1,6-hexanedioic acid | 292 mass parts |
| tetrabutoxytitanate (condensation catalyst) | 3 mass parts |

A reaction was run for 8 hours at 160° C. under a nitrogen current while distilling out the produced methanol. Then, while gradually raising the temperature to 210° C., the reaction was run for 4 hours under a nitrogen current while distilling out the produced propylene glycol and water and was additionally run for 1 hour at a reduced pressure of 20 mmHg. This was followed by cooling to 160° C.; adding 173 mass parts trimellitic anhydride and 125 mass parts 1,3-propanedioic acid; reaction for 2 hours at ambient pressure under seal; then reaction at 200° C. under ambient pressure; and recovery at the time point at which the softening point reached 160° C. After the recovered resin had been cooled to room temperature, it was particulated by grinding to obtain polyester-1 in the form of a nonlinear polyester resin. Polyester-1 had the following properties: Tg=47° C., acid value 29 mg KOH/g, and hydroxyl value=35 mg KOH/g.

<Preparation of Polyester-2>

The following were introduced into a reactor equipped with a condenser, nitrogen introduction tube, and stirrer.

| | |
|---|---|
| 1,3-butanediol | 1036 mass parts |
| dimethyl terephthalate | 892 mass parts |
| 1,6-hexanedioic acid | 205 mass parts |
| tetrabutoxytitanate (condensation catalyst) | 3 mass parts |

A reaction was run for 8 hours at 180° C. under a nitrogen current while distilling out the produced methanol. Then, while gradually raising the temperature to 230° C., the reaction was run for 4 hours under a nitrogen current while distilling out the produced propylene glycol and water. The reaction was continued at a reduced pressure of 20 mmHg and recovery was carried out at the time point at which the softening point reached 150° C. After the recovered resin had been cooled to room temperature, it was particulated by grinding to obtain polyester-2 in the form of a linear polyester resin. Polyester-2 had the following properties: Tg=38° C., acid value=15 mg KOH/g, and hydroxyl value=22 mg KOH/g.

<Preparation of Polyester-3>

The following were introduced into a reactor equipped with a condenser, nitrogen introduction tube, and stirrer.

| | |
|---|---|
| 1,2-propanediol | 799 mass parts |
| dimethyl terephthalate | 815 mass parts |
| 1,5-pentanedioic acid | 238 mass parts |
| tetrabutoxytitanate (condensation catalyst) | 3 mass parts |

A reaction was run for 9 hours at 180° C. under a nitrogen current while distilling out the produced methanol. Then, while gradually raising the temperature to 230° C., the reaction was run for 4 hours under a nitrogen current while distilling out the produced propylene glycol and water and was additionally run for 1 hour at a reduced pressure of 20 mmHg. This was followed by cooling to 180° C.; adding 173 mass parts trimellitic anhydride; reaction for 2 hours at ambient pressure under seal; then reaction at 220° C. under ambient pressure; and recovery at the time point at which the softening point reached 180° C. After the recovered resin had been cooled to room temperature, it was particulated by grinding to obtain polyester-3 in the form of a nonlinear polyester resin. Polyester-3 had the following properties: Tg 62° C., acid value=2 mg KOH/g, and hydroxyl value 18 mg KOH/g.

<Preparation of Polyester-4>

The following were introduced into a reactor equipped with a condenser, nitrogen introduction tube, and stirrer.

| | |
|---|---|
| 1,2-propanediol | 858 mass parts |
| dimethyl terephthalate | 873 mass parts |
| 1,6-hexanedioic acid | 219 mass parts |
| tetrabutoxytitanate (condensation catalyst) | 3 mass parts |

A reaction was run for 8 hours at 180° C. under a nitrogen current while distilling out the produced methanol. Then, while gradually raising the temperature to 230° C., the reaction was run for 4 hours under a nitrogen current while distilling out the produced propylene glycol and water. The reaction was continued at a reduced pressure of 20 mmHg and recovery was carried out at the time point at which the softening point reached 145° C. After the recovered resin had been cooled to room temperature, it was particulated by grinding to obtain polyester-4 in the form of a linear polyester resin. Polyester-4 had the following properties: Tg=42° C., acid value=15 mg KOH/g, and hydroxyl value 36 mg KOH/g.

<Preparation of Polyester-5>

The following were introduced into a reactor equipped with a condenser, nitrogen introduction tube, and stirrer.

| | |
|---|---|
| 1,2-propanediol | 799 mass parts |
| dimethyl terephthalate | 815 mass parts |
| 1,5-pentanedioic acid | 238 mass parts |
| tetrabutoxytitanate (condensation catalyst) | 3 mass parts |

A reaction was run for 8 hours at 180° C. under a nitrogen current while distilling out the produced methanol. Then, while gradually raising the temperature to 230° C., the reaction was run for 4 hours under a nitrogen current while distilling out the produced propylene glycol and water and was additionally run for 1 hour at a reduced pressure of 20 mmHg. This was followed by cooling to 180° C.; adding 173 mass parts trimellitic anhydride; reaction for 2 hours at ambient pressure under seal; then reaction at 220° C. under ambient pressure; and recovery at the time point at which the softening point reached 170° C. After the recovered resin had been cooled to room temperature, it was particulated by grinding to obtain polyester-5 in the form of a nonlinear polyester resin. Polyester-5 had the following properties: Tg=58° C., acid value=4 mg KOH/g, and hydroxyl value=20 mg KOH/g.

<Preparation of Polyester-6>

The following were introduced into a 4-liter glass four-neck flask.

| | |
|---|---|
| polyoxypropylene(2.2)-2,2-bis(4-hydroxyphenyl)propane | 30 mass parts |
| polyoxyethylene(2.2)-2,2-bis(4-hydroxyphenyl)propane | 33 mass parts |
| terephthalic acid | 21 mass parts |
| trimellitic anhydride | 1 mass part |
| fumaric acid | 3 mass parts |
| dodecenylsuccinic acid | 12 mass parts |
| dibutyltin oxide | 0.1 mass part |

This flask was fitted with a thermometer, stirring rod, condenser, and nitrogen inlet tube and placed in a heating mantle. A reaction was run for 4.5 hours at 215° C. under a nitrogen atmosphere to obtain polyester-6. Polyester-6 had the following properties: Tg=56° C., acid value=9 mg KOH/g, and hydroxyl value=17 mg KOH/g.

<Preparation of Polyester-7>

The following were introduced into a 4-liter glass four-neck flask.

| | |
|---|---|
| polyoxypropylene(2.2)-2,2-bis(4-hydroxyphenyl)propane | 30 mass parts |
| polyoxyethylene(2.2)-2,2-bis(4-hydroxyphenyl)propane | 33 mass parts |
| terephthalic acid | 21 mass parts |
| trimellitic anhydride | 1 mass part |
| fumaric acid | 3 mass parts |
| dodecenylsuccinic acid | 12 mass parts |
| dibutyltin oxide | 0.1 mass part |

This flask was fitted with a thermometer, stirring rod, condenser, and nitrogen inlet tube and placed in a heating mantle. A reaction was run for 4.0 hours at 210° C. under a nitrogen atmosphere to obtain polyester-7. Polyester-7 had the following properties: Tg=46° C., acid value=14 mg KOH/g, and hydroxyl value=23 mg KOH/g.

<Preparation of Polyester Resin Solutions>

Ethyl acetate was introduced into a sealable container equipped with a stirring blade; polyester as described above (polyester-1 to -7) was introduced while stirring at 100 rpm; and a polyester resin solution (polyester resin solution-1 to -7) was produced by stirring for 3 days at room temperature. The resin content (mass %) is given in Table 2.

TABLE 2

| | resin | solvent | resin content (mass %) |
|---|---|---|---|
| polyester resin solution-1 | polyester-1 | ethyl acetate | 50 |
| polyester resin solution-2 | polyester-2 | ethyl acetate | 50 |
| polyester resin solution-3 | polyester-3 | ethyl acetate | 50 |
| polyester resin solution-4 | polyester-4 | ethyl acetate | 50 |
| polyester resin solution-5 | polyester-5 | ethyl acetate | 50 |
| polyester resin solution-6 | polyester-6 | ethyl acetate | 50 |
| polyester resin solution-7 | polyester-7 | ethyl acetate | 50 |

<Preparation of Wax Dispersion-1>

| | |
|---|---|
| carnauba wax (melting point = 81° C.) (carnauba-1) | 20 mass parts |
| ethyl acetate | 80 mass parts |

The preceding were introduced into a glass beaker (from Iwaki Glass) equipped with a stirring paddle and the carnauba wax was dissolved in the ethyl acetate by heating the system to 70° C.

Then, while gently stirring at 50 rpm, the system was gradually cooled; cooling to 25° C. over 3 hours yielded a milky white fluid.

This solution and 20 mass parts 1-mm glass beads were introduced into a heat-resistant container and dispersion was performed for 3 hours using a paint shaker (from Toyo Seiki Seisaku-sho, Ltd.) to give wax dispersion-1.

A number-average particle diameter of 0.15 μm was obtained when the wax particle diameter in wax dispersion-1 was measured with an HRA (X-100) Microtrac (from Nikkiso Co., Ltd.) particle size distribution analyzer. The properties are shown in Table 3.

<Preparation of Wax Dispersion-2>

| | |
|---|---|
| stearyl stearate (melting point = 67° C.) (ester-1) | 16 mass parts |
| nitrile-functional styrene/acrylic resin (65 mass parts styrene, 35 mass parts n-butyl acrylate, 10 mass parts acrylonitrile, peak molecular weight = 8500) | 8 mass parts |
| ethyl acetate | 76 mass parts |

The preceding were introduced into a glass beaker (from Iwaki Glass) equipped with a stirring paddle and the stearyl stearate was dissolved in the ethyl acetate by heating the system to 65° C.

Wax dispersion-2 was then obtained using the same procedure as for wax dispersion-1. A number-average particle diameter of 0.12 μm was obtained when the wax particle diameter in wax dispersion-2 was measured with an HRA (X-100) Microtrac (from Nikkiso Co., Ltd.) particle size distribution analyzer. The properties are shown in Table 3.

<Preparation of Wax Dispersion-3>

| | |
|---|---|
| trimethylolpropane tribehenate (ester-2) (melting point = 58° C.) | 16 mass parts |
| nitrile-functional styrene/acrylic resin (65 mass parts styrene, 35 mass parts n-butyl acrylate, 10 mass parts acrylonitrile, peak molecular weight = 8500) | 8 mass parts |
| ethyl acetate | 76 mass parts |

The preceding were introduced into a glass beaker (from Iwaki Glass) equipped with a stirring paddle and the trimethylolpropane tribehenate was dissolved in the ethyl acetate by heating the system to 60° C.

Wax dispersion-3 was then obtained using the same procedure as for wax dispersion-1. A number-average particle diameter of 0.18 μm was obtained when the wax particle diameter in wax dispersion-3 was measured with an HRA (X-100) Microtrac (from Nikkiso Co., Ltd.) particle size distribution analyzer. The properties are shown in Table 3.

TABLE 3

| | melting point | remarks |
|---|---|---|
| carnauba-1 | 81 | wax dispersion-1 |
| ester-1 | 67 | wax dispersion-2 |
| ester-2 | 58 | wax dispersion-3 |

<Preparation of Colorant Dispersion-C1>

| | |
|---|---|
| copper phthalocyanine pigment C.I. Pigment Blue 15:3 | 80 mass parts |
| polyester-1, see above | 120 mass parts |
| ethyl acetate | 300 mass parts |
| glass beads (1 mm) | 400 mass parts |

The preceding materials were introduced into a heat-resistant glass container; dispersion was carried out for 5 hours using a paint shaker; and the glass beads were removed using a nylon mesh to obtain colorant dispersion-C1.

<Preparation of Colorant Dispersions-C2 to -C7>

The resin used in the preparation of colorant dispersion-C1 was changed to, respectively, polyester-2, -3, -4, -5, -6, and -7 to give colorant dispersion-C2, -C3, -C4, -C5, -C6, and -C7.

<Preparation of Colorant Dispersant-M1>

| | |
|---|---|
| dimethylquinacridone (C.I. Pigment Red 122) | 80 mass parts |
| polyester-1, see above | 120 mass parts |
| ethyl acetate | 300 mass parts |
| glass beads (1 mm) | 400 mass parts |

The preceding materials were introduced into a heat-resistant glass container; dispersion was carried out for 5 hours using a paint shaker; and the glass beads were removed using a nylon mesh to obtain colorant dispersion-M1.

<Preparation of Colorant Dispersion-Y1>

| | |
|---|---|
| C.I. Pigment Yellow 74 | 80 mass parts |
| polyester-1, see above | 120 mass parts |
| ethyl acetate | 300 mass parts |
| glass beads (1 mm) | 400 mass parts |

The preceding materials were introduced into a heat-resistant glass container; dispersion was carried out for 5 hours using a paint shaker; and the glass beads were removed using a nylon mesh to obtain colorant dispersion-Y1.

<Example of Carrier Production>

4.0 mass % silane coupling agent (3-(2-aminoethylaminopropyl)trimethoxysilane) was added to magnetite powder having a number-average particle diameter of 0.25 μm and to hematite powder having a number-average particle diameter of 0.60 μm; each of these was subjected to high-speed mixing/stirring in a container at a temperature of at least 100° C. in order to carry out an oleophilization treatment of each of these microparticles.

| | |
|---|---|
| phenol | 10 mass parts |
| formaldehyde solution (40 mass % formaldehyde, 10 mass % methanol, 50 mass % water) | 6 mass parts |
| oleophilized magnetite | 63 mass parts |
| oleophilized hematite | 21 mass parts |

The preceding materials, 5 mass parts 28% aqueous ammonia, and 10 mass parts water were introduced into a flask and, while stirring and mixing, the temperature was raised to 85° C. in 30 minutes and held there and curing was brought about by carrying out a polymerization reaction for 3 hours. This was followed by cooling to 30° C., the addition of more water, removal of the supernatant, washing the precipitation with water, and air drying. This was then dried at 60° C. under reduced pressure (5 mmHg or below) to obtain spherical magnetic resin particles (the carrier core) in which magnetic material was dispersed.

A copolymer of methyl methacrylate and methyl methacrylate having the perfluoroalkyl group (m=7) (copolymerization ratio=8:1, weight-average molecular weight=45,000) was used as the coating resin. 10 mass parts melamine particles (particle diameter=290 nm) and 6 mass parts carbon particles (particle diameter=30 nm, specific resistance=$1\times10^{-2}$ Ω·cm) were added to 100 mass parts of this coating resin and dispersion was carried out for 30 minutes with an ultrasound disperser. In addition, a mixed solvent coating solution (solution concentration=10 mass %) of methyl ethyl ketone and toluene was prepared such that the coating resin matter was 2.5 mass parts with respect to the carrier core.

Using this coating solution, resin coating onto the surface of the magnetic resin particles was carried out by evaporating the solvent at 70° C. while continuously applying shear stress. The resin-coated magnetic carrier particles were heat treated while being stirred at 100° C. for 2 hours, followed by cooling, disaggregation, and classification with a 200-mesh sieve to obtain a carrier having a number-average particle diameter of 33 μm, a true specific gravity of 3.53 g/cm$^3$, an apparent specific gravity of 1.84 g/cm$^3$, and an intensity of magnetization of 42 Am$^2$/kg.

Example 1

Preparation of Liquid Toner Composition 1

| | |
|---|---|
| wax dispersion-1<br>(carnauba wax solids matter: 20 mass %) | 50 mass parts |
| colorant dispersion-C1<br>(pigment solids matter: 16 mass %,<br>resin solids matter: 24 mass %) | 25 mass parts |
| polyester resin solution-1<br>(resin solids matter: 50 mass %) | 160 mass parts |
| triethylamine | 0.5 mass part |
| ethyl acetate | 14.5 mass parts |

The preceding solutions were introduced into a container and stirring dispersion was carried out for 10 minutes at 1500 rpm using a Homo Disper (Tokushu Kika Kogyo Kabushiki Kaisha). Oil phase 1 was prepared by subjecting these solutions to additional dispersion for 30 minutes at ambient temperature with an ultrasound disperser.

Preparation of the Aqueous Phase

The aqueous phase was prepared by introducing the following into a container and stirring for 1 minute at 5000 rpm with a TK Homomixer (Tokushu Kika Kogyo Kabushiki Kaisha).

| | |
|---|---|
| ion-exchanged water | 200.5 mass parts |
| resin microparticle dispersion-1<br>(10.0 mass parts resin microparticles per 100 mass parts toner base particles) | 50.0 mass parts |
| 50% aqueous solution of sodium dodecyldiphenyl ether disulfonate<br>(Eleminol MON-7 from Sanyo Chemical Industries, Ltd.) | 25.0 mass parts |
| ethyl acetate | 30.0 mass parts |

(The Emulsification and Solvent Removal Steps)

The oil phase 1 was suspended by introducing the oil phase into the aqueous phase and continuing to stir for 1 minute with a TK Homomixer at up to 8000 rpm.

A stirring blade was then attached to the container and the system was heated to 50° C. while stirring at 200 rpm and the solvent was removed over 5 hours with the pressure reduced to 500 mmHg, thus yielding an aqueous dispersion of toner particles.

(The Washing and Drying Steps)

The aqueous toner particle dispersion was then filtered and re-slurried in 500 mass parts ion-exchanged water. Then, while the system was being stirred, hydrochloric acid was added until the pH in the system reached 4 and stirring was carried out for 5 minutes. The residual triethylamine in the system was removed by carrying out the following process three times: re-filtration of the slurry, addition of 200 mass parts ion-exchanged water, and stirring for 5 minutes. A toner particle filter cake was obtained.

This filter cake was dried for 3 days at 45° C. in a convection dryer. Screening with a 75 μm-aperture mesh yielded toner particles 1.

Toner Production

Toner 1 was then obtained by mixing 0.7 mass part hydrophobic silica (average diameter=20 nm) and 3.0 mass parts strontium titanate (average diameter=120 nm) per 100 mass parts toner particles 1 using a Henschel mixer model FM-10B (from Mitsui Miike Kakoki Co., Ltd.).

The toner component composition is given in Table 4 and the toner properties are given in Table 5.

<Preparation of Two-Component Developer 1>

Two-component developer 1 comprising a mixture of 8 mass parts of the previously described toner 1 and 92 mass parts of the previously described carrier was prepared.

The methods for evaluating the obtained toners are described in the following.

<Image Evaluation>

(Fine Line Reproducibility)

The two-component developer 1 described above was submitted to evaluation using a commercial color copier (product name: CLC5000, from Canon Kabushiki Kaisha) for image evaluation. The image evaluation results for the toners are shown in Table 6.

The test machine for this image evaluation was held overnight in a 23° C./5% RH environment. A durability test was then run in which 10,000 sheets were printed out using A4 plain paper (75 g/m$^2$). A horizontal line pattern with a print percentage of 3% was employed in a 1 sheet/1 job configuration, and the mode was set so the machine temporarily stopped between jobs, after which the next job was started.

The fine line reproducibility was evaluated during this durability test at the completion of 10 sheets (initial) and at the completion of the 10,000 sheets.

First, the measurement sample was the fixed image printed on thick paper (105 g/m$^2$) after laser photoexposure so as to provide a latent image line width of 85 μm. A Luzex 450 Particle Analyzer (Nireco Corporation) was used as the measurement instrumentation, and the line width was measured from the enlarged image on the monitor using the indicator. Here, due to the presence of unevenness across the width in the fine line toner image, a measurement point that was the average line width of the unevenness was used for the line width measurement position. The fine line reproducibility was evaluated by calculating the ratio (line width ratio) of the measured line width value to the latent image line width (85 μm). The evaluation criterion for the fine line reproducibility is given below.

Evaluation Criterion

The ratio (line width ratio) of the measured line width value to the latent image line width is

| | |
|---|---|
| A | less than 1.08. |
| B | at least 1.08 and less than 1.12. |
| C | at least 1.12 and less than 1.18. |
| D | at least 1.18. |

<Evaluation of the Low-Temperature Fixability>

The previously described two-component developer 1 and the previously described CLC5000 color laser copier (Canon) were used for this evaluation. The development contrast on this copier was adjusted to give a toner laid-on level on the paper of 1.2 mg/cm$^2$, and a solid black, unfixed image (leading edge margin=5 mm, width=100 mm, length=280 mm) was produced in single color mode in the ambient temperature, ambient humidity environment (23° C./60% RH). A thick A4 stock (Plover Bond from Fox River, 105 g/m$^2$) was used as the paper. The fixing unit of the CLC5000 (Canon) was modified so the fixation temperature could be manually set. Using this modified fixing unit, a fixed image was obtained at the particular temperature from the solid black, unfixed image in the ambient temperature, ambient humidity environment (23° C./60% RH), while stepping up the fixation temperature in 10° C. increments in the range from 80° C. to 200° C.

A soft thin paper (for example, Dusper (product name) from the Ozu Corporation) was overlaid on the image area of the fixed image thereby obtained, and the image area was then rubbed back-and-forth five times while a load of 4.9 kPa was applied from the top of the thin paper. The image density was measured both before and after this rubbing operation and the decline in the image density ΔD (%) was calculated using the formula given below. The temperature at which this ΔD (%) assumed a value less than 10% was taken to be the fixation onset temperature, and the low-temperature fixability was evaluated based on the evaluation criterion given below. The results are shown in Table 6. The image density was measured using an X-Rite 404A color reflection densitometer (manufacturer: X-Rite, Incorporated).

$$\Delta D(\%)=\{(\text{image density before rubbing}-\text{image density after rubbing})/\text{image density before rubbing}\}\times 100$$

Evaluation Criterion

A: fixation onset temperature less than or equal to 120° C.

B: fixation onset temperature greater than 120° C., but less than or equal to 140° C.

C: fixation onset temperature greater than 140° C., but less than or equal to 160° C.

D: fixation onset temperature greater than 160° C.

In the present invention, the low-temperature fixability was considered to be excellent when the score was rank A or B.

<Evaluation of Charging (Tribo)>

1.0 g toner and 19.0 g of the designated carrier (reference carrier N-01 according to The Imaging Society of Japan, spherical carrier comprising a surface-treated ferrite core) are each placed in lidded plastic bottles and held for 1 day in a designated environment. The designated environments are N/L (temperature=23.0° C., humidity=5%) and H/H (temperature=30.0° C., humidity=80%).

The charging (tribo) was evaluated using the triboelectric charge quantity of the toner.

The method used to measure the toner triboelectric charge quantity is described in the following.

Figure 2:
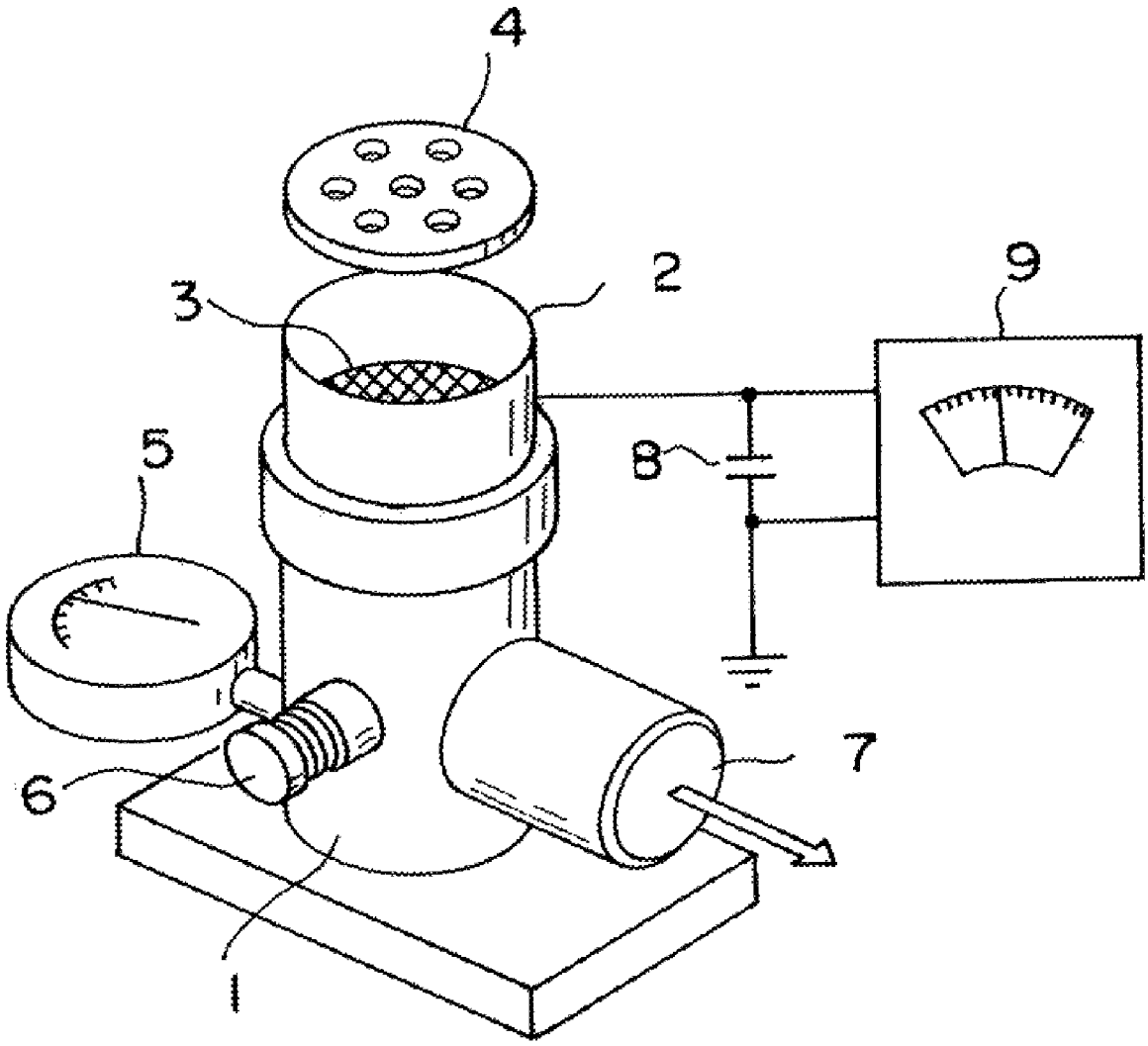
FIG. 2 is a schematic drawing of a device for measuring the triboelectric charge quantity.

First, the toner and the designated carrier (reference carrier N-01 according to The Imaging Society of Japan, spherical carrier comprising a surface-treated ferrite core) are introduced into a lidded plastic bottle, and the developer comprising the toner and carrier is charged by shaking with a shaker (YS-LD from Yayoi Co., Ltd.), for 1 minute at a speed of 4 back-and-forth excursions per second in the H/H environment (for the N/L environment, shaking is carried out for 1 minute at a speed of 4 back-and-forth excursions per second and for 1 hour at a speed of 4 back-and-forth excursions per second). The triboelectric charge quantity is then measured using a device, shown in FIG. 2, for measuring the triboelectric charge quantity. Referring to FIG. 2, approximately 0.5 to 1.5 g of the aforementioned developer is introduced into the metal measurement container 2 having a 500-mesh screen 3 at the bottom and the metal cap 4 is applied. The mass of the entire measurement container 2 at this point is weighed and designated W1 (g). Then, at the suction apparatus 1 (at least the part in contact with the measurement container 2 is an insulator), suction is carried out through the suction port 7 and the pressure on the vacuum gauge 5 is brought to 250 mmAq by adjusting the air stream control valve 6. Suction is carried out for 2 minutes in this state to suction off the toner. The potential on the potentiometer 9 at this time is designated V (in volts). Here, 8 refers to a capacitor, and its capacity is designated C (mF). In addition, the weight of the entire measurement container is measured post-suction and designated W2 (g). The quantity of triboelectric charge (mC/kg) of the sample is then calculated using the following formula. The results are given in Table 6.

$$\text{triboelectric charge quantity of the sample (mC/kg)}=C\times V/(W1-W2)$$

Evaluation Criterion

| | |
|---|---|
| A | The triboelectric charge quantity of the sample is greater than or equal to −35 mC/kg and less than or equal to −25 mC/kg. |
| B | The triboelectric charge quantity of the sample is greater than or equal to −40 mC/kg and less than −35 mC/kg, or is greater than −25 mC/kg and less than or equal to −20 mC/kg. |
| C | The triboelectric charge quantity of the sample is greater than or equal to −45 mC/kg and less than −40 mC/kg, or is greater than −20 mC/kg and less than or equal to −15 mC/kg. |
| D | The triboelectric charge quantity of the sample is less than −45 mC/kg or greater than −15 mC/kg. |

<Resistance to Hot Storage>

Approximately 10 g toner was placed in a 100-mL plastic cup and was held for 3 days at 50° C., after which a visual evaluation was performed. The results are given in Table 6.

Evaluation Criterion

A: aggregates are not seen

B: aggregates are seen, but are easily broken up

C: aggregates can be grasped and are not easily broken up

D: the aggregates do not break up

Comparative Example 1

Toner 2 was obtained proceeding as in Example 1, except that the aqueous phase was prepared under the conditions given below. Toner 2 was evaluated as in Example 1. The toner component composition is given in Table 4; the toner properties are given in Table 5; and the results of the evaluations are given in Table 6.

Preparation of the Aqueous Phase

The aqueous phase was prepared by introducing the following into a container and stirring for 1 minute at 5000 rpm with a TK Homomixer (Tokushu Kika Kogyo Kabushiki Kaisha).

| | |
|---|---|
| ion-exchanged water | 200.5 mass parts |
| resin microparticle dispersion-2 (10.0 mass parts resin microparticles per 100 mass parts toner base particles) | 50.0 mass parts |
| 50% aqueous solution of sodium dodecyldiphenyl ether disulfonate (Eleminol MON-7 from Sanyo Chemical Industries, Ltd.) | 25.0 mass parts |
| ethyl acetate | 30.0 mass parts |

Comparative Example 2

Toner 3 was obtained proceeding as in Example 1, except that the aqueous phase was prepared under the conditions given below. Toner 3 was evaluated as in Example 1. The toner component composition is given in Table 4; the toner properties are given in Table 5; and the results of the evaluations are given in Table 6.

Preparation of the Aqueous Phase

The aqueous phase was prepared by introducing the following into a container and stirring for 1 minute at 5000 rpm with a TK Homomixer (Tokushu Kika Kogyo Kabushiki Kaisha).

| | |
|---|---|
| ion-exchanged water | 200.5 mass parts |
| resin microparticle dispersion-3 (10.0 mass parts resin microparticles per 100 mass parts toner base particles) | 50.0 mass parts |
| 50% aqueous solution of sodium dodecyldiphenyl ether disulfonate (Eleminol MON-7 from Sanyo Chemical Industries, Ltd.) | 25.0 mass parts |
| ethyl acetate | 30.0 mass parts |

Comparative Example 3

Toner 4 was obtained proceeding as in Example 1, except that the oil phase was prepared under the conditions given below. Toner 4 was evaluated as in Example 1. The toner component composition is given in Table 4; the toner properties are given in Table 5; and the results of the evaluations are given in Table 6.

Preparation of the Liquid Toner Composition

| | |
|---|---|
| wax dispersion-1 (carnauba wax solids matter: 20 mass %) | 50 mass parts |
| colorant dispersion-C2 (pigment solids matter: 16 mass %, resin solids matter: 24 mass %) | 25 mass parts |
| polyester resin solution-2 (resin solids matter: 50 mass %) | 160 mass parts |
| triethylamine | 0.5 mass part |
| ethyl acetate | 14.5 mass parts |

The preceding solutions were introduced into a container and stirring dispersion was carried out for 10 minutes at 1500 rpm using a Homo Disper (Tokushu Kika Kogyo Kabushiki Kaisha). The oil phase was prepared by subjecting these solutions to additional dispersion for 30 minutes at ambient temperature with an ultrasound disperser.

Comparative Example 4

Toner 5 was obtained proceeding as in Example 1, except that the oil phase was prepared under the conditions given below. Toner 5 was evaluated as in Example 1. The toner component composition is given in Table 4; the toner properties are given in Table 5; and the results of the evaluations are given in Table 6.

Preparation of the Liquid Toner Composition

| | |
|---|---|
| wax dispersion-1 (carnauba wax solids matter: 20 mass %) | 50 mass parts |
| colorant dispersion-C3 (pigment solids matter: 16 mass %, resin solids matter: 24 mass %) | 25 mass parts |
| polyester resin solution-3 (resin solids matter: 50 mass %) | 160 mass parts |
| triethylamine | 0.5 mass part |
| ethyl acetate | 14.5 mass parts |

The preceding solutions were introduced into a container and stirring/dispersion was carried out for 10 minutes at 1500 rpm using a Homo Disper (Tokushu Kika Kogyo Kabushiki Kaisha). The oil phase was prepared by subjecting these solutions to additional dispersion for 30 minutes at ambient temperature with an ultrasound disperser.

Comparative Example 5

Toner 6 was obtained proceeding as in Example 1, except that the aqueous phase was prepared under the conditions given below. Toner 6 was evaluated as in Example 1. The toner component composition is given in Table 4; the toner properties are given in Table 5; and the results of the evaluations are given in Table 6.

Preparation of the Aqueous Phase

The aqueous phase was produced by introducing the following into a container and stirring for 1 minute at 5000 rpm with a TK Homomixer (Tokushu Kika Kogyo Kabushiki Kaisha).

| | |
|---|---|
| ion-exchanged water | 243.0 mass parts |
| resin microparticle dispersion-1 (1.5 mass parts resin microparticles per 100 mass parts toner base particles) | 7.5 mass parts |
| 50% aqueous solution of sodium dodecyldiphenyl ether disulfonate (Eleminol MON-7 from Sanyo Chemical Industries, Ltd.) | 25.0 mass parts |
| ethyl acetate | 30.0 mass parts |

Comparative Example 6

Toner 7 was obtained proceeding as in Example 1, except that the aqueous phase was prepared under the conditions given below. Toner 7 was evaluated as in Example 1. The toner component composition is given in Table 4; the toner properties are given in Table 5; and the results of the evaluations are given in Table 6.

Preparation of the Aqueous Phase

The aqueous phase was prepared by introducing the following into a container and stirring for 1 minute at 5000 rpm with a TK Homomixer (Tokushu Kika Kogyo Kabushiki Kaisha).

| | |
|---|---|
| ion-exchanged water | 165.5 mass parts |
| resin microparticle dispersion-1 (17.0 mass parts resin microparticles per 100 mass parts toner base particles) | 85.0 mass parts |
| 50% aqueous solution of sodium dodecyldiphenyl ether disulfonate (Eleminol MON-7 from Sanyo Chemical Industries, Ltd.) | 25.0 mass parts |
| ethyl acetate | 30.0 mass parts |

Comparative Example 7

Toner 8 was obtained proceeding as in Example 1 and using the oil and aqueous phases prepared in Example 1, with the exception that the emulsification and solvent removal steps were changed as indicated below. Toner 8 was evaluated as in Example 1. The toner component composition is given in Table 4; the toner properties are given in Table 5; and the results of the evaluations are given in Table 6.

(The Emulsification and Solvent Removal Steps)

The oil phase 1 was suspended by introducing the oil phase into the aqueous phase and continuing to stir for 5 minutes with a TK Homomixer at tip to 15000 rpm.

A stirring blade was then attached to the container and the system was heated to 50° C. while stirring at 200 rpm and the solvent was removed over 5 hours with the pressure reduced to 500 mmHg, thus yielding an aqueous dispersion of toner particles.

Comparative Example 8

Toner 9 was obtained proceeding as in Example 1, except that the aqueous phase was prepared under the conditions given below. Toner 9 was evaluated as in Example 1. The toner component composition is given in Table 4; the toner properties are given in Table 5; and the results of the evaluations are given in Table 6.

Preparation of the Aqueous Phase

The aqueous phase was prepared by introducing the following into a container and stirring for 1 minute at 5000 rpm with a TK Homomixer (Tokushu Kika Kogyo Kabushiki Kaisha).

| | |
|---|---|
| ion-exchanged water | 200.5 mass parts |
| resin microparticle dispersion-4 (10.0 mass parts resin microparticles per 100 mass parts toner base particles) | 50.0 mass parts |
| 50% aqueous solution of sodiumdodecyldiphenyl ether disulfonate (Eleminol MON-7 from Sanyo Chemical Industries, Ltd.) | 25.0 mass parts |
| ethyl acetate | 30.0 mass parts |

Examples 2 and 3

Toners 10 (Example 2) and 11 (Example 3) were obtained by the same method as in Example 1, but in this case using resin microparticle dispersion-5 or -6 in place of the resin microparticle dispersion-1 that was used in Example 1. Toners 10 and 11 were evaluated as in Example 1. The toner component composition is given in Table 4; the toner properties are given in Table 5; and the results of the evaluations are given in Table 6.

Examples 4 and 5

Toners 12 (Example 4) and 13 (Example 5) were obtained by the same method as in Example 1, but in this case using polyester resin dispersion-4 or -5 in place of the polyester resin solution-1 that was used in Example 1 and using the quantity of resin microparticle addition indicated in Table 4. Toners 12 and 13 were evaluated as in Example 1. The toner component composition is given in Table 4; the toner properties are given in Table 5; and the results of the evaluations are given in Table 6.

Example 6

Toner 14 was obtained proceeding as in Example 1, except that the aqueous phase was prepared under the conditions given below. Toner 14 was evaluated as in Example 1. The toner component composition is given in Table 4; the toner properties are given in Table 5; and the results of the evaluations are given in Table 6.

Preparation of the Aqueous Phase

The aqueous phase was prepared by introducing the following into a container and stirring for 1 minute at 5000 rpm with a TK Homomixer (Tokushu Kika Kogyo Kabushiki Kaisha).

| | |
|---|---|
| ion-exchanged water | 200.5 mass parts |
| resin microparticle dispersion-1 (2.3 mass parts resin microparticles per 100 mass parts toner base particles) | 11.5 mass parts |
| 50% aqueous solution of sodium dodecyldiphenyl ether disulfonate (Eleminol MON-7 from Sanyo Chemical Industries, Ltd.) | 25.0 mass parts |
| ethyl acetate | 30.0 mass parts |

Example 7

Toner 1.5 was obtained proceeding as in Example 1, except that the aqueous phase was prepared under the conditions given below. Toner 15 was evaluated as in Example 1. The toner component composition is given in Table 4; the toner properties are given in Table 5; and the results of the evaluations are given in Table 6.

Preparation of the Aqueous Phase

The aqueous phase was prepared by introducing the following into a container and stirring for 1 minute at 5000 rpm with a TK Homomixer (Tokushu Kika Kogyo Kabushiki Kaisha).

| | |
|---|---|
| ion-exchanged water | 127.5 mass parts |
| resin microparticle dispersion-1 (14.6 mass parts resin microparticles per 100 mass parts toner base particles) | 73.0 mass parts |
| 50% aqueous solution of sodium dodecyldiphenyl ether disulfonate (Eleminol MON-7 from Sanyo Chemical Industries, Ltd.) | 25.0 mass parts |
| ethyl acetate | 30.0 mass parts |

Example 8

Toner 16 was obtained proceeding as in Example 1, except that the oil and aqueous phases were prepared under the conditions. given below. Toner 16 was evaluated as in Example 1. The toner component composition is given in Table 4; the toner properties are given in Table 5; and the results of the evaluations are given in Table 6.

Preparation of the Liquid Toner Composition

| | |
|---|---|
| wax dispersion-2 (ester-1 solids matter: 16 mass %, dispersant solids matter: 8 mass %) | 75 mass parts |
| colorant dispersion-C6 (pigment solids matter: 16 mass %, resin solids matter: 24 mass %) | 37.5 mass parts |
| polyester resin solution-6 (resin solids matter: 50 mass %) | 134 mass parts |
| triethylamine | 0.5 mass part |
| ethyl acetate | 3.0 mass parts |

The preceding solutions were introduced into a container and stirring/dispersion was carried out for 10 minutes at 1500 rpm using a Homo Disper (Tokushu Kika Kogyo Kabushiki Kaisha). The oil phase was prepared by subjecting these solutions to additional dispersion for 30 minutes at ambient temperature with an ultrasound disperser.

Preparation of the Aqueous Phase

The aqueous phase was prepared by introducing the following into a container and stirring for 1 minute at 5000 rpm with a TK Homomixer (Tokushu Kika Kogyo Kabushiki Kaisha).

| | |
|---|---|
| ion-exchanged water | 230.5 mass parts |
| resin microparticle dispersion-7 (4.0 mass parts resin microparticles per 100 mass parts toner base particles) | 20.0 mass parts |
| 50% aqueous solution of sodium dodecyldiphenyl ether disulfonate (Eleminol MON-7 from Sanyo Chemical Industries, Ltd.) | 25.0 mass parts |
| ethyl acetate | 30.0 mass parts |

Example 9

Toner 17 was obtained proceeding as in Example 1, except that the oil and aqueous phases were prepared under the conditions given below. Toner 17 was evaluated as in Example 1. The toner component composition is given in Table 4; the toner properties are given in Table 5; and the results of the evaluations are given in Table 6.

Preparation of the Liquid Toner Composition

| | |
|---|---|
| wax dispersion-3 (ester wax solids matter: 16 mass %, dispersant: 8 mass %) | 43.75 mass parts |
| colorant dispersion-C7 (pigment solids matter: 16 mass %, resin solids matter: 24 mass %) | 18.75 mass parts |
| polyester resin solution-7 (resin solids matter: 50 mass %) | 163 mass parts |
| triethylamine | 0.5 mass part |
| ethyl acetate | 24.0 mass parts |

The preceding solutions were introduced into a container and stirring/dispersion was carried out for 10 minutes at 1.500 rpm using a Homo Disper (Tokushu Kika Kogyo Kabushiki Kaisha). The oil phase was prepared by subjecting these solutions to additional dispersion for 30 minutes at ambient temperature with an ultrasound disperser.

Preparation of the Aqueous Phase

The aqueous phase was prepared by introducing the following into a container and stirring for 1 minute at 5000 rpm with a TK Homomixer (Tokushu Kika Kogyo Kabushiki Kaisha).

| | |
|---|---|
| ion-exchanged water | 191.5 mass parts |
| resin microparticle dispersion-8 (11.8 mass parts resin microparticles per 100 mass parts toner base particles) | 59.0 mass parts |
| 50% aqueous solution of sodium dodecyldiphenyl ether disulfonate (Eleminol MON-7 from Sanyo Chemical Industries, Ltd.) | 25.0 mass parts |
| ethyl acetate | 30.0 mass parts |

Example 10

Toner 18 was obtained proceeding as in Example 1, except that the oil phase was prepared under the conditions given below. Toner 18 was evaluated as in Example 1. The toner component composition is given in Table 4; the toner properties are given in Table 5; and the results of the evaluations are given in Table 6.

Preparation of the Liquid Toner Composition

| | |
|---|---|
| wax dispersion-1 (carnauba wax solids matter: 20 mass %) | 50 mass parts |
| colorant dispersion-M1 (pigment solids matter: 16 mass %, resin solids matter: 24 mass %) | 37.5 mass parts |
| polyester resin solution-1 (resin solids matter: 50 mass %) | 150 mass parts |
| triethylamine | 0.5 mass part |
| ethyl acetate | 18.5 mass parts |

The preceding solutions were introduced into a container and stirring/dispersion was carried out for 10 minutes at 1500 rpm using a Homo Disper (Tokushu Kika Kogyo Kabushiki Kaisha). The oil phase was prepared by subjecting these solutions to additional dispersion for 30 minutes at ambient temperature with an ultrasound disperser.

Example 11

Toner 19 was obtained proceeding as in Example 1, except that the oil phase was prepared under the conditions given below. Toner 19 was evaluated as in Example 1. The toner component composition is given in Table 4; the toner properties are given in Table 5; and the results of the evaluations are given in Table 6.

Preparation of the Liquid Toner Composition

| | |
|---|---|
| wax dispersion-1 (carnauba wax solids matter: 20 mass %) | 50 mass parts |
| colorant dispersion-Y1 (pigment solids matter: 16 mass %, resin solids matter: 24 mass %) | 50 mass parts |
| polyester resin solution-1 (resin solids matter: 50 mass %) | 140 mass parts |
| triethylamine | 0.5 mass part |
| ethyl acetate | 10.0 mass parts |

The preceding solutions were introduced into a container and stirring/dispersion was carried out for 10 minutes at 1500 rpm using a Homo Disper (Tokushu Kika Kogyo Kabushiki Kaisha). The oil phase was prepared by subjecting these solutions to additional dispersion for 30 minutes at ambient temperature with an ultrasound disperser.

TABLE 4

| | toner base particle (A) | | | | | | | | surface layer | |
|---|---|---|---|---|---|---|---|---|---|---|
| | resin (a) | | wax | | additive | | colorant | | resin (b) | |
| | type | addition (mass parts) | type | addition (mass parts) | type | addition (mass parts) | type*1) | addition (mass parts) | type | addition (mass parts) |
| toner 1 | polyester 1 | 86 | carnauba-1 | 10 | | | PB-15:3 | 4 | b-1 | 10 |
| toner 2 | polyester 1 | 86 | carnauba-1 | 10 | | | PB-15:3 | 4 | b-2 | 10 |
| toner 3 | polyester 1 | 86 | carnauba-1 | 10 | | | PB-15:3 | 4 | b-3 | 10 |
| toner 4 | polyester 2 | 86 | carnauba-1 | 10 | | | PB-15:3 | 4 | b-1 | 10 |
| toner 5 | polyester 3 | 86 | carnauba-1 | 10 | | | PB-15:3 | 4 | b-1 | 10 |
| toner 6 | polyester 1 | 86 | carnauba-1 | 10 | | | PB-15:3 | 4 | b-1 | 1.5 |
| toner 7 | polyester 1 | 86 | carnauba-1 | 10 | | | PB-15:3 | 4 | b-1 | 17 |
| toner 8 | polyester 1 | 86 | carnauba-1 | 10 | | | PB-15:3 | 4 | b-1 | 10 |
| toner 9 | polyester 1 | 86 | carnauba-1 | 10 | | | PB-15:3 | 4 | b-4 | 10 |
| toner 10 | polyester 1 | 86 | carnauba-1 | 10 | | | PB-15:3 | 4 | b-5 | 10 |
| toner 11 | polyester 1 | 86 | carnauba-1 | 10 | | | PB-15:3 | 4 | b-6 | 10 |
| toner 12 | polyester 4 | 86 | carnauba-1 | 10 | | | PB-15:3 | 4 | b-1 | 10 |
| toner 13 | polyester 5 | 86 | carnauba-1 | 10 | | | PB-15:3 | 4 | b-1 | 7 |
| toner 14 | polyester 1 | 86 | carnauba-1 | 10 | | | PB-15:3 | 4 | b-1 | 2.3 |
| toner 15 | polyester 1 | 86 | carnauba-1 | 10 | | | PB-15:3 | 4 | b-1 | 14.6 |
| toner 16 | polyester 6 | 76 | ester-1 | 12 | dispersant-1 | 6 | PB-15:3 | 6 | b-7 | 4 |
| toner 17 | polyester 7 | 86 | ester-1 | 7 | dispersant-1 | 3.5 | PB-15:3 | 3.5 | b-8 | 11.8 |
| toner 18 | polyester 1 | 84 | carnauba-1 | 10 | | | PR-122 | 6 | b-1 | 10 |
| toner 19 | polyester 1 | 82 | carnauba-1 | 10 | | | PY-74 | 8 | b-1 | 10 |

*1)C.I. Pigment Blue, C.I. Pigment Red, and C.I. Pigment Yellow are indicated by PB, PR, and PY.

TABLE 5

| | | particle diameter (D4) (μm) | D4/D1 | glass-transition temperature (Tg) (° C.) Tg (0.5) | Tg (4.0) | Tg (4.0)-Tg (0.5) | hydroxyl value per specific surface area | nitrogen content (N) (atomic %) | visco-elasticity G'' maximum value | G'(130) | avg. circular-iity | no. % of toner less than or equal to 2 μm |
|---|---|---|---|---|---|---|---|---|---|---|---|---|
| Ex. 1 | toner 1 | 5.5 | 1.12 | 48.2 | 52.8 | 4.6 | 4.7 | 5.2 | 47.1 | $1.2 \times 10^4$ | 0.986 | 0.7 |
| Comp. Ex. 1 | toner 2 | 5.5 | 1.14 | 48.3 | 60.6 | 12.3 | 0.4 | 6.3 | 47.9 | $2.3 \times 10^3$ | 0.982 | 1.1 |
| Comp. Ex. 2 | toner 3 | 5.5 | 1.18 | 48.2 | 51.8 | 3.6 | 10.6 | 3.2 | 47.5 | $8.7 \times 10^2$ | 0.983 | 2.4 |
| Comp. Ex. 3 | toner 4 | 5.5 | 1.13 | 39.1 | 44.2 | 5.1 | 4.2 | 5.1 | 38.8 | $9.2 \times 10^2$ | 0.981 | 1.3 |
| Comp. Ex. 4 | toner 5 | 5.5 | 1.12 | 62.3 | 66.5 | 4.2 | 4 | 5.4 | 62 | $3.1 \times 10^3$ | 0.98 | 1.6 |
| Comp. Ex. 5 | toner 6 | 5.5 | 1.28 | 47.8 | 49.4 | 1.6 | 0.3 | 0.8 | 47.5 | $6.3 \times 10^2$ | 0.977 | 1.4 |
| Comp. Ex. 6 | toner 7 | 5.5 | 1.26 | 48.5 | 59.7 | 11.2 | 8.3 | 8.3 | 48.2 | $2.0 \times 10^5$ | 0.978 | 3.1 |
| Comp. Ex. 7 | toner 8 | 5.5 | 1.22 | 47.5 | 47.7 | 0.2 | 1.4 | 0.3 | 47.3 | $7.2 \times 10^2$ | 0.981 | 2.3 |
| Comp. Ex. 8 | toner 9 | 5.3 | 1.32 | 48.6 | 63.9 | 15.3 | 1.1 | 0 | 48.1 | $4.6 \times 10^5$ | 0.962 | 1.2 |
| Ex. 2 | toner 10 | 5.7 | 1.18 | 43.7 | 55.9 | 7.2 | 0.6 | 2.2 | 48.6 | $9.1 \times 10^4$ | 0.983 | 1.3 |
| Ex. 3 | toner 11 | 5.4 | 1.16 | 47.8 | 50.5 | 2.7 | 9.7 | 6.7 | 47.6 | $2.2 \times 10^3$ | 0.981 | 0.9 |
| Ex. 4 | toner 12 | 5.5 | 1.14 | 41.7 | 46.4 | 4.7 | 4.6 | 5.1 | 41.3 | $1.6 \times 10^3$ | 0.978 | 1 |
| Ex. 5 | toner 13 | 5.2 | 1.12 | 58.8 | 62.3 | 3.5 | 4.2 | 3.9 | 58.1 | $7.7 \times 10^4$ | 0.983 | 1.2 |
| Ex. 6 | toner 14 | 7.1 | 1.16 | 48.1 | 50.2 | 2.1 | 3.2 | 1.2 | 47.6 | $1.5 \times 10^4$ | 0.981 | 1.4 |
| Ex. 7 | toner 15 | 4.8 | 1.17 | 46.4 | 58.2 | 9.8 | 6.1 | 7.2 | 48.2 | $1.2 \times 10^4$ | 0.988 | 0.7 |
| Ex. 8 | toner 16 | 5.7 | 1.1 | 57.3 | 61.1 | 3.8 | 2.8 | 2.8 | 56.4 | $3.1 \times 10^4$ | 0.981 | 0.9 |
| Ex. 9 | toner 17 | 6.1 | 1.12 | 46.8 | 53.5 | 6.7 | 7.3 | 6.8 | 45.9 | $4.7 \times 10^3$ | 0.978 | 0.8 |
| Ex. 10 | toner 18 | 5.5 | 1.14 | 48.3 | 52.5 | 4.2 | 4.4 | 4.9 | 48.1 | $1.8 \times 10^4$ | 0.985 | 1.1 |
| Ex. 11 | toner 19 | 5.5 | 1.15 | 48.6 | 52.5 | 3.9 | 4.2 | 4.6 | 51.9 | $2.1 \times 10^4$ | 0.982 | 0.8 |

TABLE 6

| | | resistance to hot storage | low-temperature fixability | N/L tribo after shaking for 1 minute | after shaking for 1 hour | H/H tribo after shaking for 1 minute | fine line reproducibility initial | after 10,000 sheet durability test |
|---|---|---|---|---|---|---|---|---|
| Ex. 1 | toner 1 | A | A | A | A | A | A | A |
| Comp. Ex. 1 | toner 2 | A | D | A | D | A | A | A |
| Comp. Ex. 2 | toner 3 | A | A | A | A | D | A | C |
| Comp. Ex. 3 | toner 4 | D | A | A | A | A | A | A |
| Comp. Ex. 4 | toner 5 | A | D | A | A | A | A | A |
| Comp. Ex. 5 | toner 6 | D | A | A | D | A | B | D |
| Comp. Ex. 6 | toner 7 | A | D | A | A | A | B | C |

TABLE 6-continued

| | | | | N/L tribo | | H/H tribo | fine line reproducibility | |
|---|---|---|---|---|---|---|---|---|
| | | resistance to hot storage | low-temperature fixability | after shaking for 1 minute | after shaking for 1 hour | after shaking for 1 minute | initial | after 10,000 sheet durability test |
| Comp. Ex. 7 | toner 8 | D | A | A | D | A | B | D |
| Comp. Ex. 8 | toner 9 | A | D | A | A | A | B | C |
| Ex. 2 | toner 10 | A | A | A | B | A | A | A |
| Ex. 3 | toner 11 | A | A | A | A | B | A | A |
| Ex. 4 | toner 12 | B | A | A | A | A | A | A |
| Ex. 5 | toner 13 | A | B | A | A | A | A | A |
| Ex. 6 | toner 14 | A | A | A | A | A | A | B |
| Ex. 7 | toner 15 | A | B | A | A | A | A | A |
| Ex. 8 | toner 16 | A | A | A | A | A | A | A |
| Ex. 9 | toner 17 | A | A | A | A | A | A | A |
| Ex. 10 | toner 18 | A | A | A | A | A | A | A |
| Ex. 11 | toner 19 | A | A | A | A | A | A | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-059754, filed Mar. 10, 2008, which is hereby incorporated by reference herein in its entirety.

What is claimed is:

1. A toner comprising: a toner particle that comprises at least (a) resin having polyester as the main component, colorant, wax, and (b) urethane resin, wherein the hydroxyl value per specific surface area of the toner particle is at least 0.5 mg KOH/$m^2$ and no more than 10.0 mg KOH/$m^2$, the toner has a Tg(0.5) of at least 40° C. and no more than 60° C. and a Tg(4.0)-Tg(0.5) of at least 2.0° C. and no more than 10.0° C., where Tg(0.5) is the glass transition temperature of the toner measured with a differential scanning calorimeter (DSC) at a rate of temperature rise of 0.5° C./min and Tg(4.0) is the glass transition temperature of the toner measured with the DSC at a rate of temperature rise of 4.0° C./min, wherein the toner particle is a capsule-type toner particle that has a surface layer (B) comprising the (b) urethane resin as the main component, at the surface of a toner base particle (A) that comprises at least the (a) resin comprising polyester as the main component, the colorant and the wax and the (b) urethane resin has a hydroxyl value of at least 10 mg KOH/g and no more than 200 mg KOH/g.

2. The toner according to claim 1, wherein the nitrogen content (N) of the surface of the toner particle as measured by x-ray photoelectron spectroscopy (ESCA) is at least 0.5 atomic % and less than 7.0 atomic %.

3. The toner according to claim 1, wherein according to viscoelastic measurements, the maximum value for the loss elastic modulus G" of the toner is given at the temperature of at least 40° C. and no more than 60° C., and the toner has a storage elastic modulus G' at 130° C. of at least $1.0'10^3$ dN/$m^2$ and less than $1.0\times10^5$ dN/$m^2$.

4. The toner according to claim 1, wherein the weight-average particle diameter (D4) of the toner is at least 4.0 mm and no more than 9.0 mm and the toner contains no more than 2.0 number % particles that are at least 0.60 mm and no more than 2.00 mm.

5. The toner according to claim 1, wherein the toner has a ratio D4/D1 of the weight-average particle diameter (D4) to the number-average particle diameter (D1) of no greater than 1.25.

6. The toner according to claim 1, wherein the toner has an average circularity of at least 0.970 and no more than 1.000.

7. The toner according to claim 1, wherein [NCO]/[OH] for the (b) urethane resin is at least 0.5 and no more than 1.0 where [OH] is the total number of moles of diol component and [NCO] is the total number of moles of diisocyanate component.

8. The toner according to claim 1, wherein the number-average molecular weight (Mn) of the tetrahydrofuran (THF)-soluble matter of the (b) urethane resin as measured by gel permeation chromatography (GPC) is at least 1,000 and no more than 5,000.

9. The toner according to claim 1, wherein the surface layer (B) comprising the (b) urethane resin is formed by resin microparticles comprising the (b) urethane resin and having a number-average particle diameter of at least 30 nm and no more than 150 nm.

10. The toner according to claim 1, wherein the surface layer (B) is at least 2.0 mass % and no more than 15.0 mass % with respect to the toner base particle (A).

11. The toner according to claim 1, wherein the wax is an ester wax.

12. The toner according to claim 1, wherein the toner particle is obtained by dissolving or dispersing at least the (a) resin having polyester as the main component, the colorant, and the wax in an organic medium to obtain a solution or dispersion; dispersing the obtained solution or dispersion in an aqueous medium in which resin microparticles comprising the (b) urethane resin are dispersed; and drying to remove a solvent from the obtained dispersion.

13. The toner according to claim 1 wherein [NCO]/[OH] for the (b) urethane resin is from 0.74 to 0.92 where [OH] is the total number of moles of diol component and [NCO] is the total number of moles of diisocyanate component.

14. The toner according to claim 1, wherein the (b) urethane resin has a hydroxyl value of 23 mg KOH/g to 82 mg KOH/g.

* * * * *